US006069557A

United States Patent [19]

Anglin, Jr. et al.

[11] Patent Number: 6,069,557

[45] Date of Patent: May 30, 2000

[54] AUTOMATIC LONG-LIFE INFRARED EMITTER & LOCATOR SYSTEM

[76] Inventors: Richard L. Anglin, Jr., 2115 Heather La., Del Mar, Calif. 92014; Bradley J. Busson, 11150 Friar Dr., Hayden Lake, Id. 83835; William J. Doucette, 369 S. Rosalinda Ave., Azusa, Calif. 91702; Carolyn M. Steward, 3251 Dothan La., Dallas, Tex. 75229

[21] Appl. No.: 09/119,419

[22] Filed: Jul. 20, 1998

[51] Int. Cl.[7] ..... G08B 23/00

[52] U.S. Cl. ..... 340/321; 340/331; 340/953; 340/691; 340/825.34; 340/825.44; 340/825.54; 340/573.1

[58] Field of Search ..... 340/321, 825.54, 340/825.34, 825.44, 331, 573.1, 691, 370.01, 983, 953; 375/1; 250/215; 342/45; 116/209

[56] References Cited

U.S. PATENT DOCUMENTS

| | | | |
|---|---|---|---|
| 2,513,071 | 6/1950 | Wendt | 362/194 |
| 2,520,503 | 8/1950 | Henning, Jr. | 362/158 |
| 2,949,530 | 8/1960 | Hagen et al. | 362/194 |
| 3,708,671 | 1/1973 | Story | 340/870.01 |
| 5,034,847 | 7/1991 | Brain | 362/205 |
| 5,172,110 | 12/1992 | Tiefengraber | 340/825.49 |
| 5,299,227 | 3/1994 | Rose | 375/200 |
| 5,390,581 | 2/1995 | Hiltz et al. | 89/1.812 |
| 5,400,008 | 3/1995 | Toohey | 340/32 |
| 5,414,405 | 5/1995 | Hogg et al. | 340/32 |
| 5,719,567 | 2/1998 | Norris | 340/953 |
| 5,804,829 | 9/1998 | Palmer | 250/504 H |
| 5,929,777 | 7/1999 | Reynolds | 340/825.49 |

*Primary Examiner*—Benjamin C. Lee
*Attorney, Agent, or Firm*—Anglin & Giaccherini

[57] ABSTRACT

An Automatic Long-Life Infrared Emitter & Locator System which may be used to locate persons in need of assistance or marked objects is disclosed. Since the emitter (10) operates continuously and emanates infrared radiation (21) that can not be seen by the user, no affirmative action is required to activate the emitter (10). One of the preferred embodiments of the present invention (10) includes a flexible plastic or rubber housing (12) having an opening (15) that is specially shaped to fit over and to finly grasp a conventional electrical battery (16). A lens (18) residing on the top of the housing (12) passes invisible energy issuing from an infrared emitting diode (20) deployed beneath it. The diode (20) is connected to the battery (16) by leads (19) through a pulse control circuit (22). This circuit (22) produces intense and regular spikes of energy that cause the diode (20) to flash over a period of many weeks. The preferred embodiment (10) may be worn on a hiker's shirtsleeve (42) or hat (40), or may be installed on equipment carried by the hiker, such as a backpack (44). The invention may be attached to a boat (50), a car (52) or a skipole (46). This innovative device can be used to mark virtually any location, or could be employed to identify friendly troops on the battlefield. When combined with commercially available night vision equipment, the emitter (10) can help pinpoint any location that may not otherwise be perceived by the unaided eye.

2 Claims, 30 Drawing Sheets

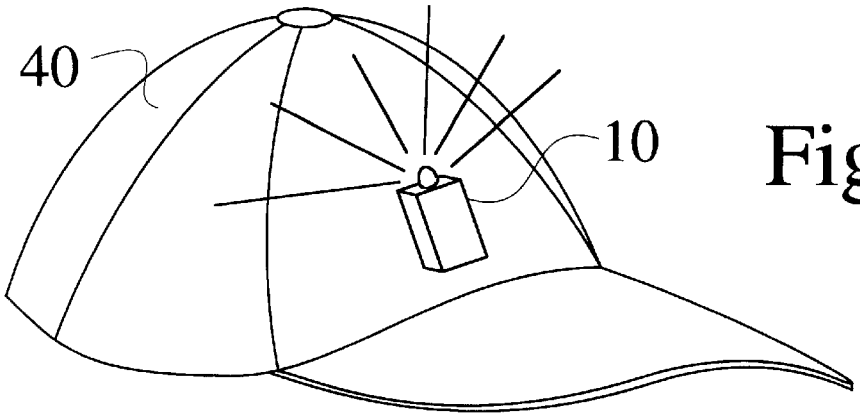
Fig. 14
Fig. 15
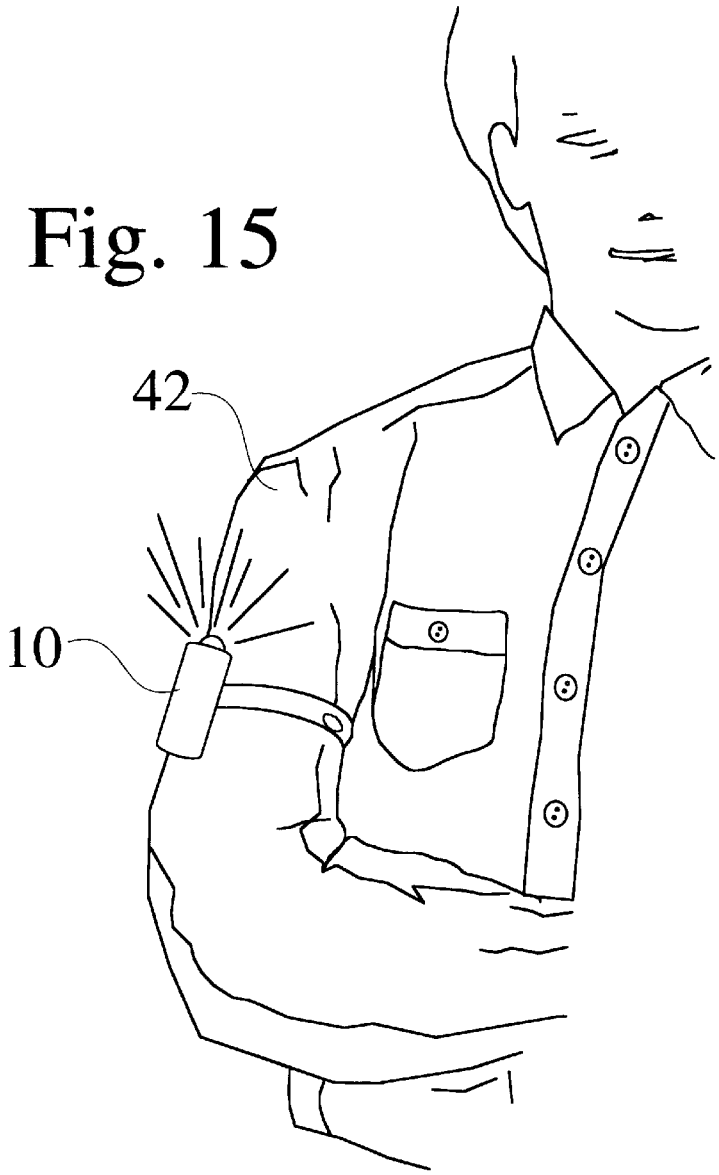

AUTOMATIC LONG-LIFE INFRARED EMITTER & LOCATOR SYSTEM

FEDERALLY SPONSORED RESEARCH OR DEVELOPMENT

Not applicable.

FIELD OF THE INVENTION

The present invention relates to the field of locating devices. More particularly, this invention provides novel methods and apparatus for providing a user with an automatic electronic infrared emitter, which need not be activated in the event of an emergency since it can remain on at all times. The lightweight and inexpensive emitter produces invisible high intensity radiation and may be found in an emergency with an infrared detector if the user becomes lost or disabled. The invention may also be beneficially employed in a wide variety of situations that are not emergencies.

BACKGROUND OF THE INVENTION

Each year some number of hikers, boaters, skiers, and outdoor enthusiasts encounter some difficulties that require emergency assistance. Some become lost while others are injured, bitten or succumb to the deleterious effects of unexpected bad weather. An extremely small number of these unfortunate people carry sophisticated radio equipment in the event they need to call for help. The vast majority, however, are relatively unprepared if disaster strikes and must rely on being rescued by paramedics or search parties. If those in need are stranded at night without a two-way radio, a fire, or a flashlight of some kind to indicate their position, rescue efforts can consume precious additional time and lives may be threatened.

A few partial solutions to the problem of locating persons who are lost or incapacitated outdoors include common flashlights or hiker's mirrors. These devices are limited, however, because they require some action to be taken by the user once some trouble or peril is encountered. If a hiker falls and becomes caught or unconscious, or if a boater is thrown into the water with only a life-preserver, it may not be possible to activate or operate some device that is designed to attract the attention of a rescuer flying overhead.

Some police, fire or paramedic rescue teams carry night vision equipment that is capable of sensing the body heat generated by people who require assistance. As an example, the Intevac Company of Palo Alto, Calif., markets "Generation III™" image intensifiers that can be used at night to detect heat sources. Many aerospace companies build complex and expensive night vision systems for use by the military. Hughes Aircraft Company manufactures a system called "Probeye™", while GEC-Marconi sells a lightweight thermal imaging camera. Without a relatively bright infrared source that illuminates the position of those in need of rescue, the utility of this heat sensitive night vision equipment can be somewhat limited.

None of the night vision equipment described above offers an inexpensive, automatic and lightweight device which can help individuals in the wilderness attract assistance when they need it. The problem of providing a compact emitter that may be used as a location device has presented a major challenge to designers in the electronics business. The development of a simple and cost-effective apparatus that could be manufactured in large numbers and utilized by a wide variety of persons who venture outdoors would constitute a major technological advance and would satisfy a long felt need within the consumer electronics industry and emergency response management agencies.

SUMMARY OF THE INVENTION

The Automatic Long-Life Infrared Emitter & Locator System will assist rescuers in their attempts to locate persons who are immobilized or lost in the wilderness. Because the invention is always operating when in use by emanating infrared radiation that can not be seen by the user, no affirmative action is required to activate the emitter. The invention will be able to send signals to a prospective rescuer flying overhead even if the person who needs help is incapacitated or unconscious.

One of the preferred embodiments of the present invention includes a flexible plastic or rubber housing having an opening that is specially shaped to fit over and to firmly grasp a conventional electrical battery. A lens residing on the top of the housing focuses invisible energy issuing from an infrared emitting diode deployed beneath it. The diode is connected to the battery by leads through a pulse control circuit. This circuit produces intense and regular spikes of energy that cause the diode to flash over a period of many weeks. The preferred embodiment can be worn on a hiker's sleeve, collar or hat, or can be installed on equipment carried by the hiker, such as a backpack. The invention may be carried by boaters, skiers, hunters, or can be used to help track automobiles or migrating animals. This innovative device can be used to mark virtually any location, or could be employed to identify friendly troops on the battlefield. When combined with commercially available night vision equipment, the emitter can help pinpoint any location that may not otherwise be perceived by the unaided eye.

An appreciation of other aims and objectives of the present invention and a more complete and comprehensive understanding of this invention may be achieved by studying the following description of a preferred embodiment and by referring to the accompanying drawings.

A BRIEF DESCRIPTION OF THE DRAWINGS

FIG. 1 is a schematic diagram which depicts one of the preferred embodiments that may be employed to implement the present invention. This figure reveals a perspective view of a cap that may be fitted over a nine volt dry cell. The cap includes an infrared source, pulse control circuitry, an on-off switch and a lens. This embodiment also includes an adhesive patch or swivel ring which enables the user to attach the invention to his or her clothing, backpack or vehicle.

FIG. 2 is a schematic top view of the apparatus portrayed in FIG. 1.

FIG. 3 reveals a schematic diagram of one pulse control circuit that may be utilized to practice the present invention.

FIG. 4 exhibits a pin connection diagram of a dual in-line package integrated circuit flasher/oscillator which may be employed to control the flash output of the invention.

Figure 7:
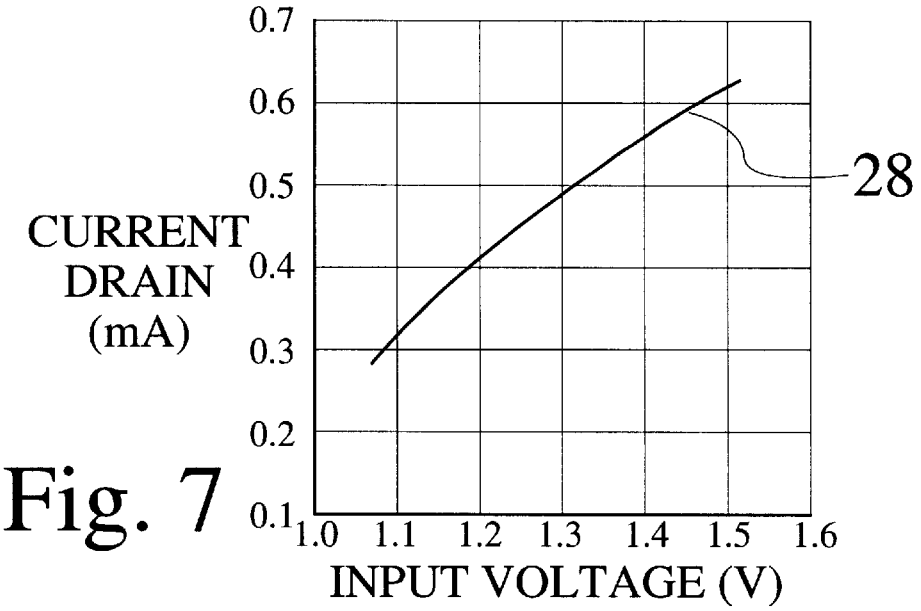
Figure 8:
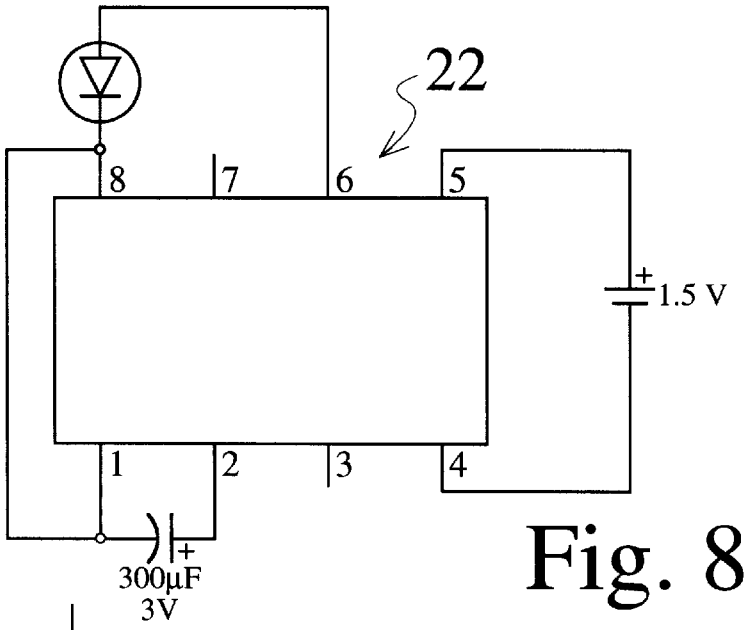

FIG. 7 presents a graph that plots input voltage versus typical current drain in milliamps for the 1.5 volt flasher circuit shown in FIG. 8.

Figure 4:
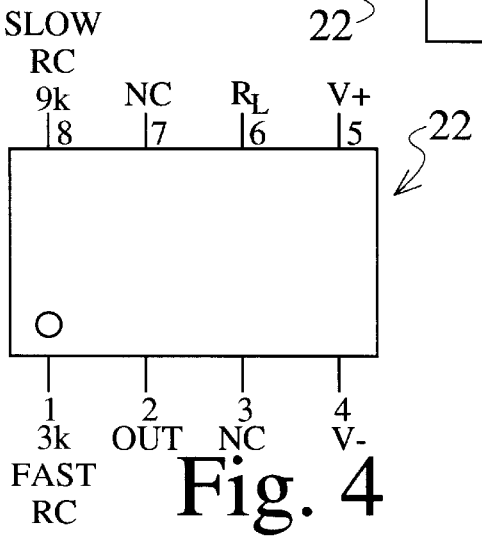

FIG. 8 is a detailed circuit diagram of the chip depicted in FIG. 4. For the arrangement shown in FIG. 8, the nominal flash rate is one flash per second (1 Hz).

Figure 9:
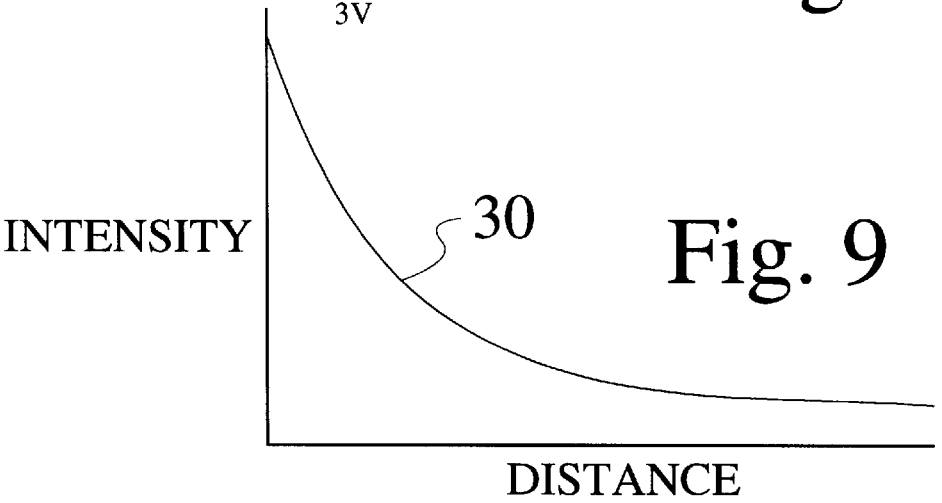

FIG. 9 supplies a graph that plots the intensity or brightness of the infrared energy emitted by one of the preferred embodiments of the invention for a specified distance away from the emitter.

Figure 1:
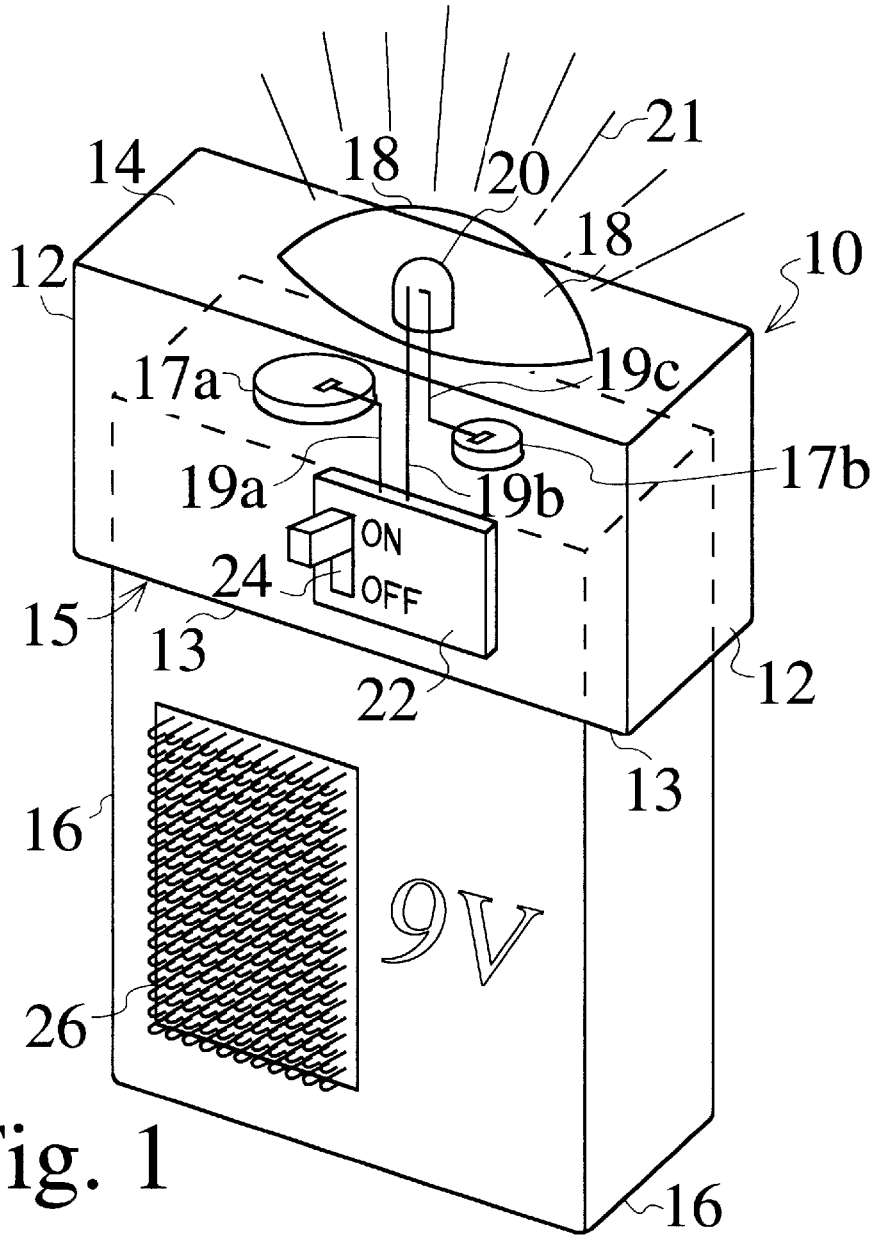
Figure 10:
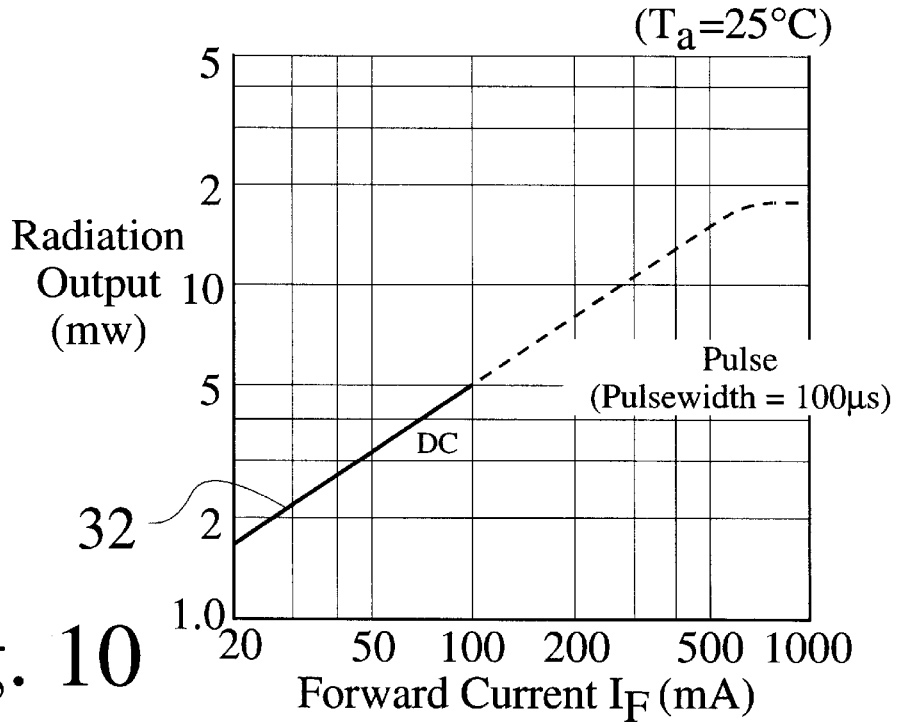
Figure 11:
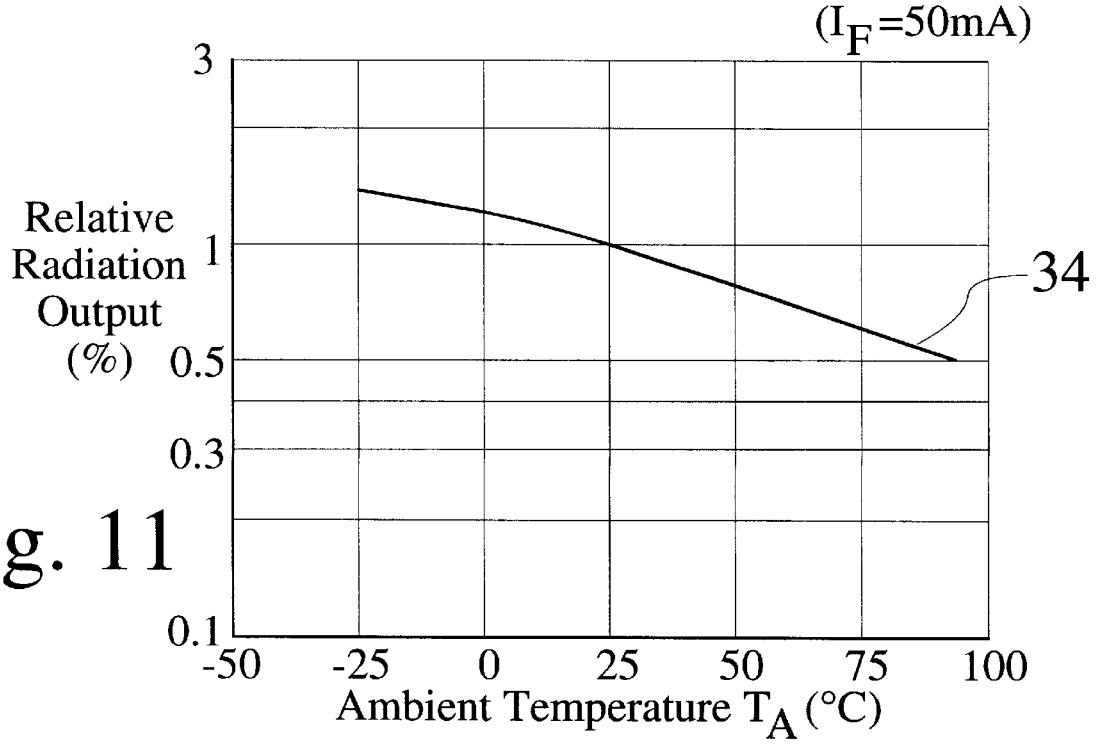
Figure 12:
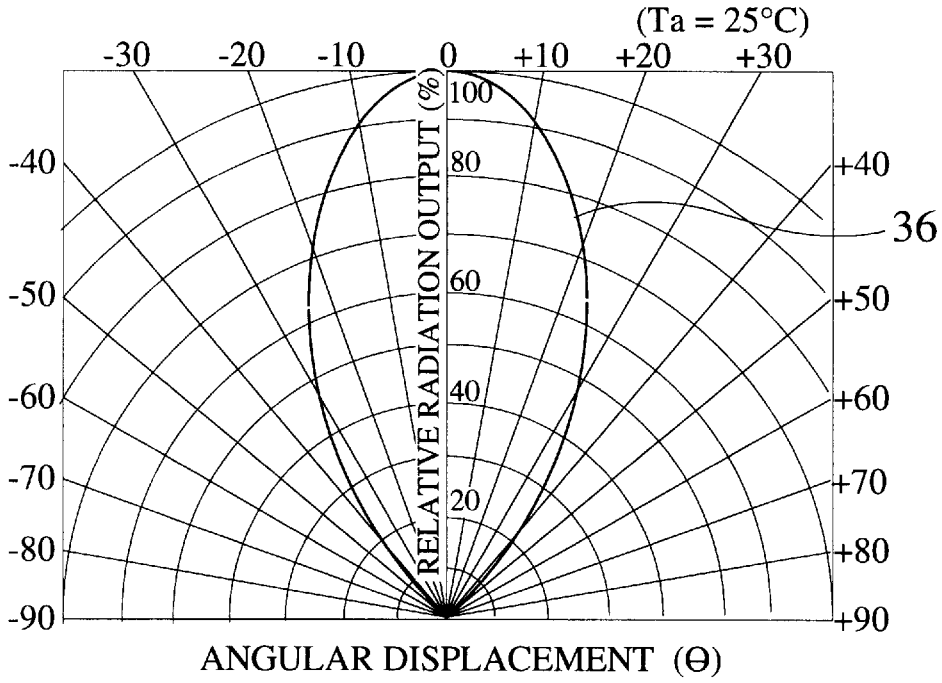
Figure 13:
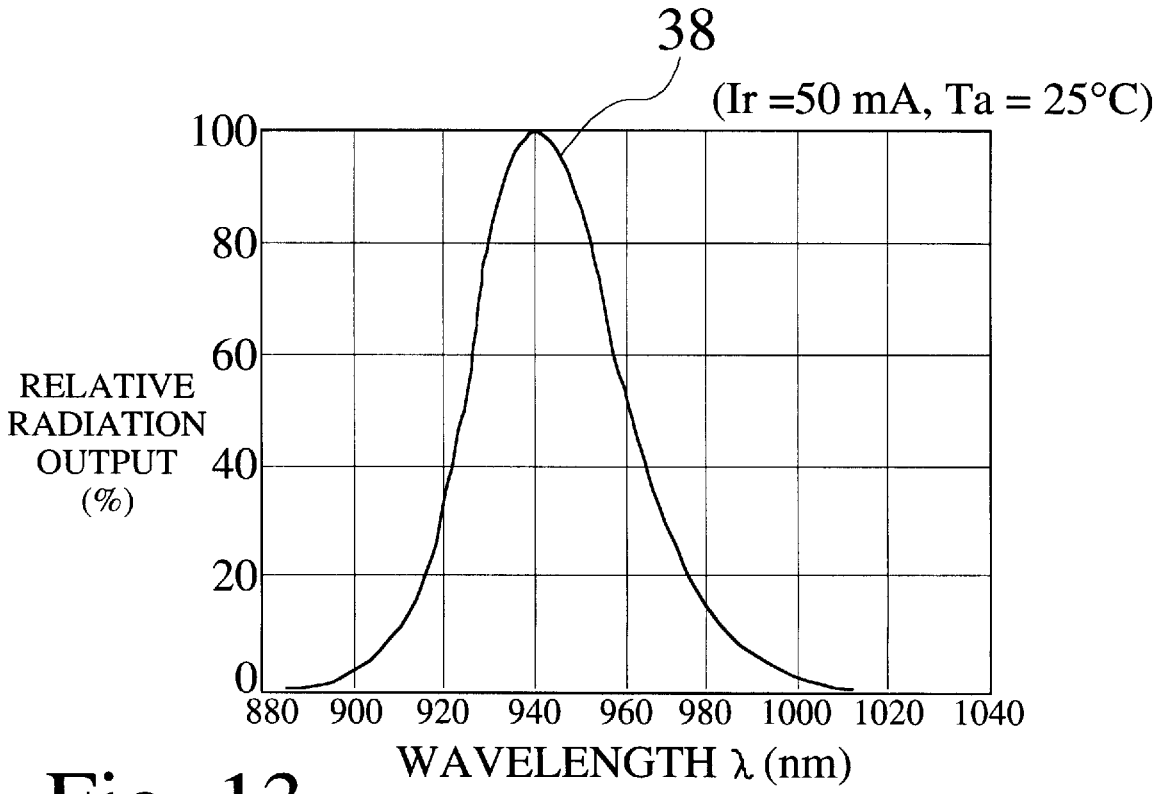

FIGS. 10, 11, 12 and 13 provide test data for a commercially available infrared emitting diode that may be incorporated in the embodiment illustrated in FIG. 1. FIG. 10 is a graph of radiation output in milliwatts versus forward current in milliamps. FIG. 11 compares relative radiation output in percent and ambient temperature in degrees Celsius at a given forward current. FIG. 12 characterizes the directional radiation pattern emitted by the diode. FIG. 13 provides a plot of relative radiation output in percent versus wavelength in nanometers.

FIGS. 14 and 15 show the present invention attached to various articles of clothing.

Figure 16:
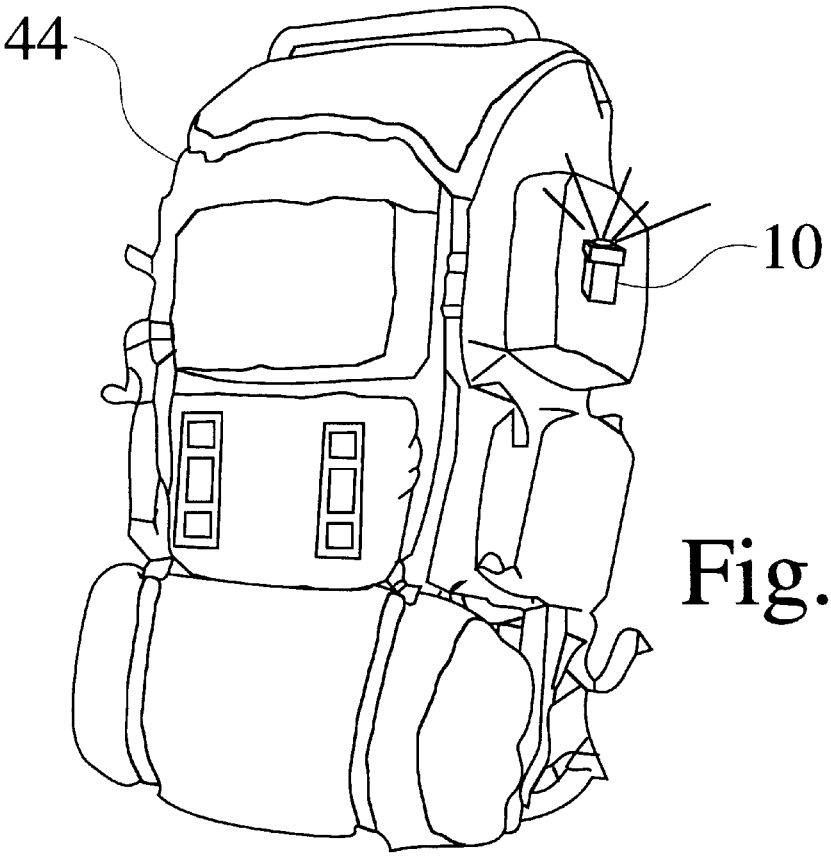
Figure 17:
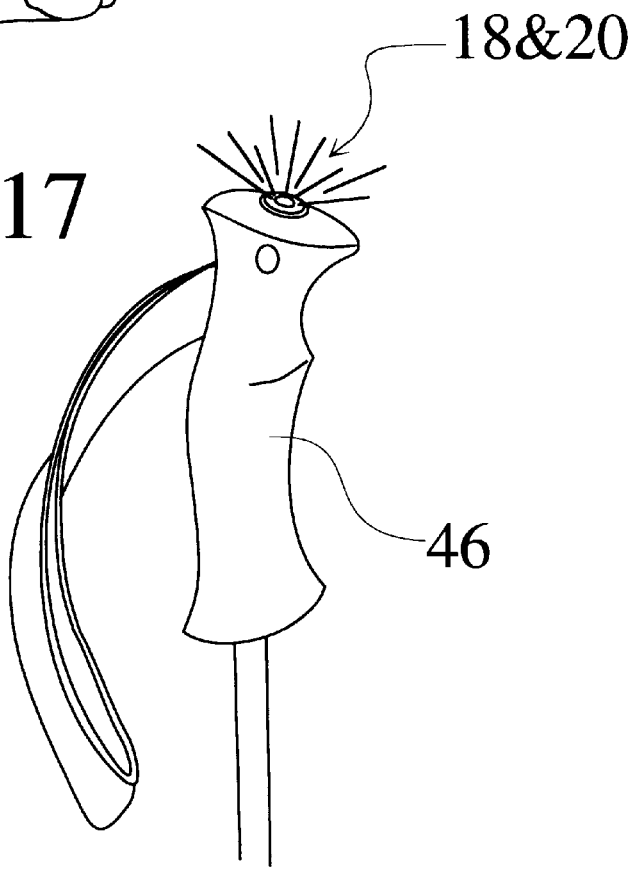
Figure 18:
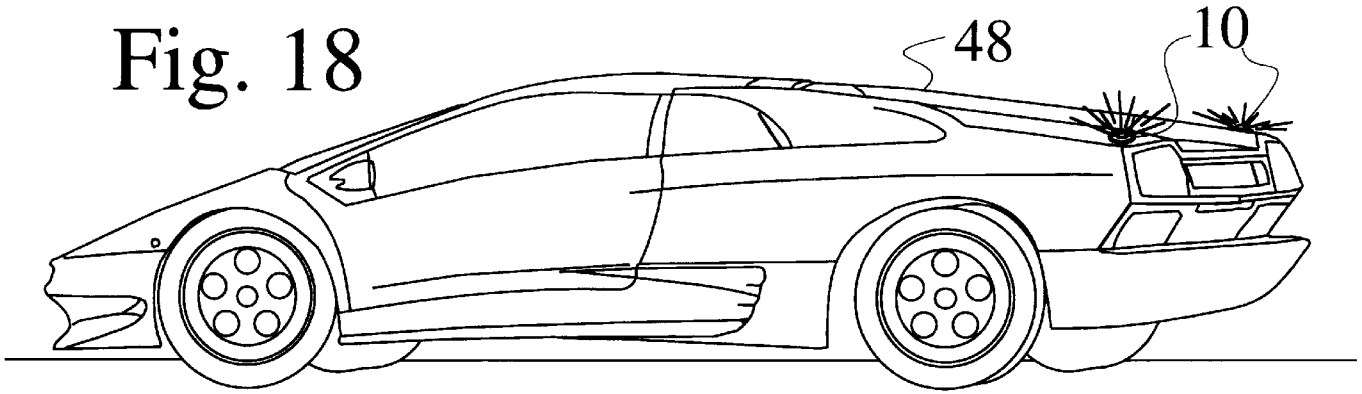
Figure 19:
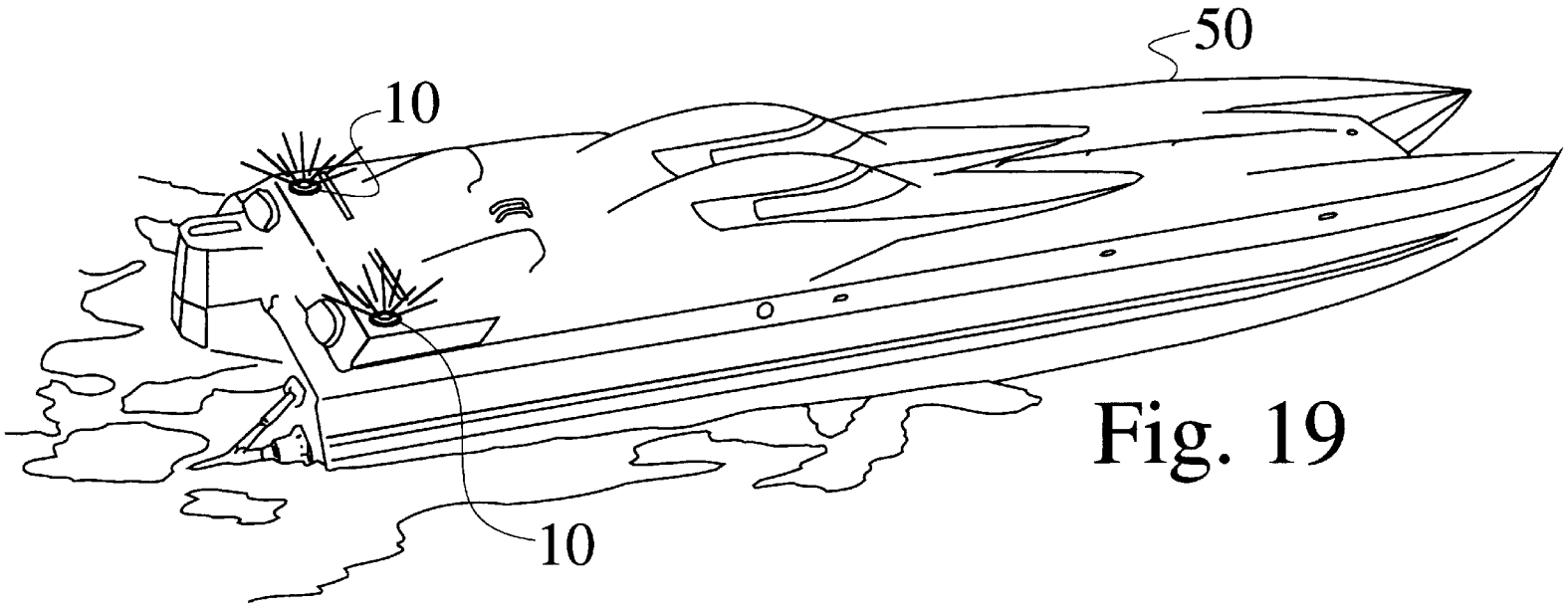
Figure 20:
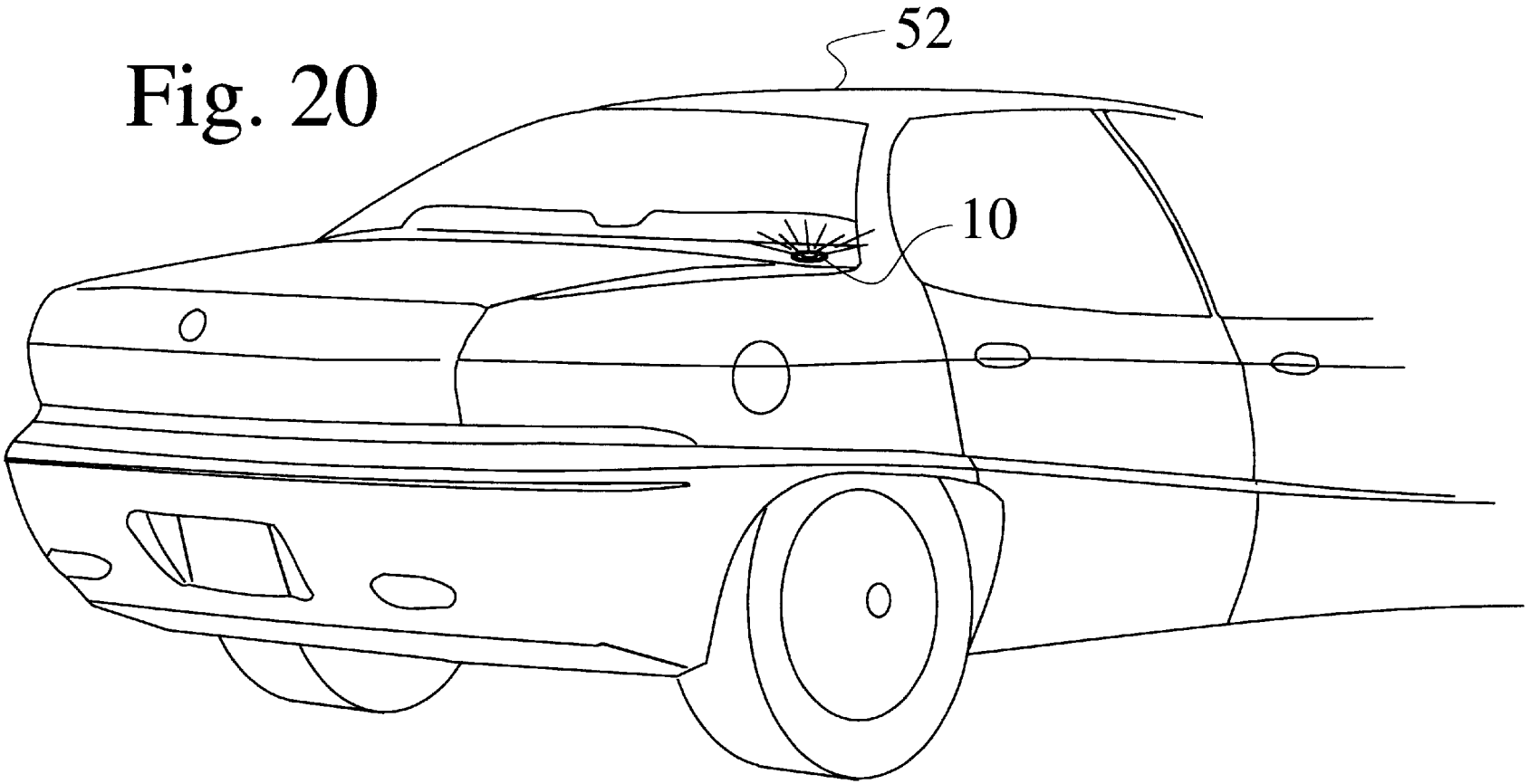
Figure 21:
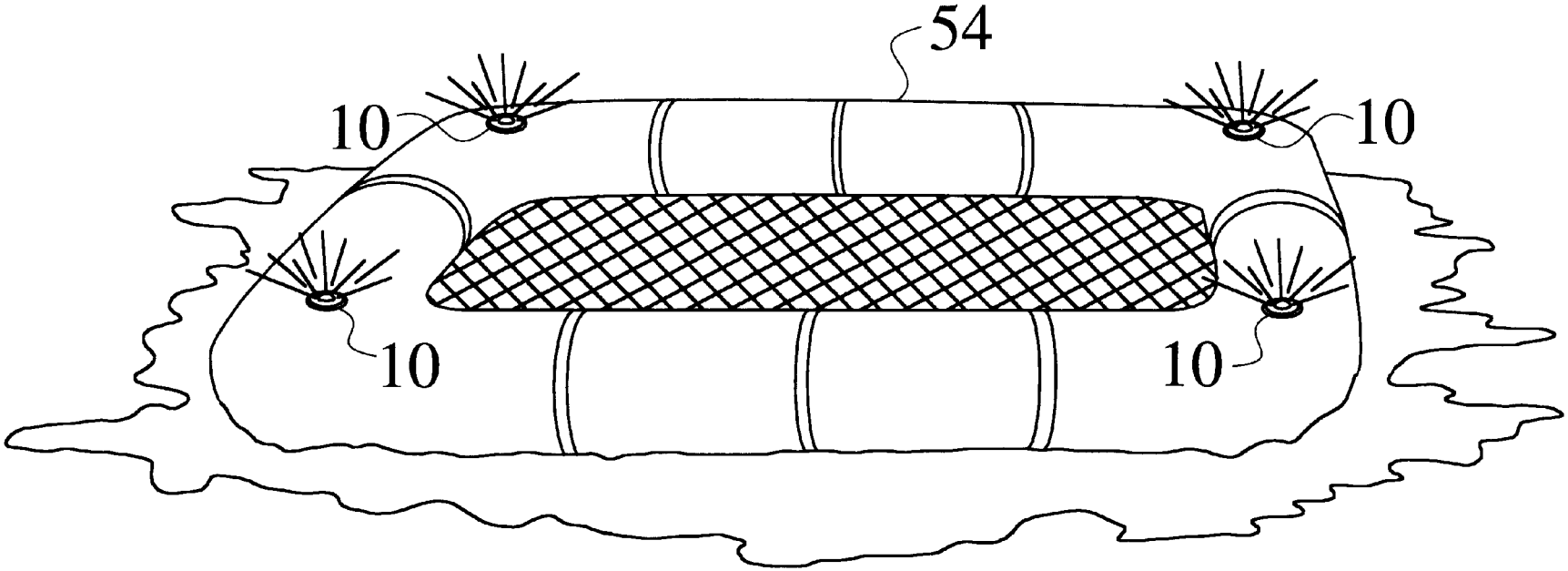

FIGS. 16 through 21 portray one preferred embodiment of the present invention in the context of specific applications. FIG. 16 shows the invention attached to a backpack; FIG. 17 is an illustration of the invention formed into the top of a ski pole; FIG. 18 offers a view of the invention mounted on the rear fenders of a racing auto; FIG. 19 reveals an emitter affixed to a boat; FIG. 20 shows how the invention may be employed with a passenger car; and FIG. 21 is a depiction of the invention installed on an inflatable life boat.

Figure 22:
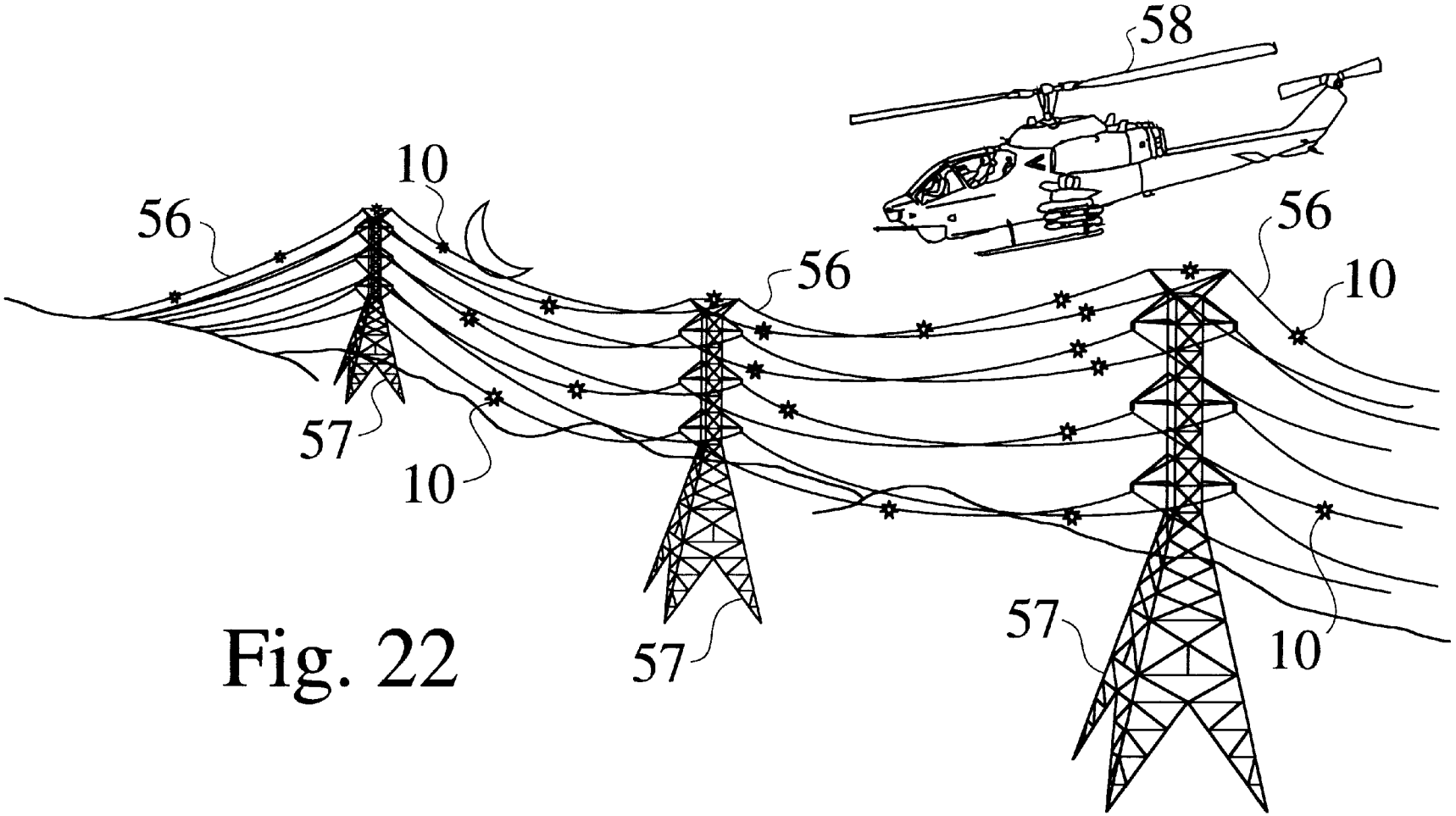
Figure 23:
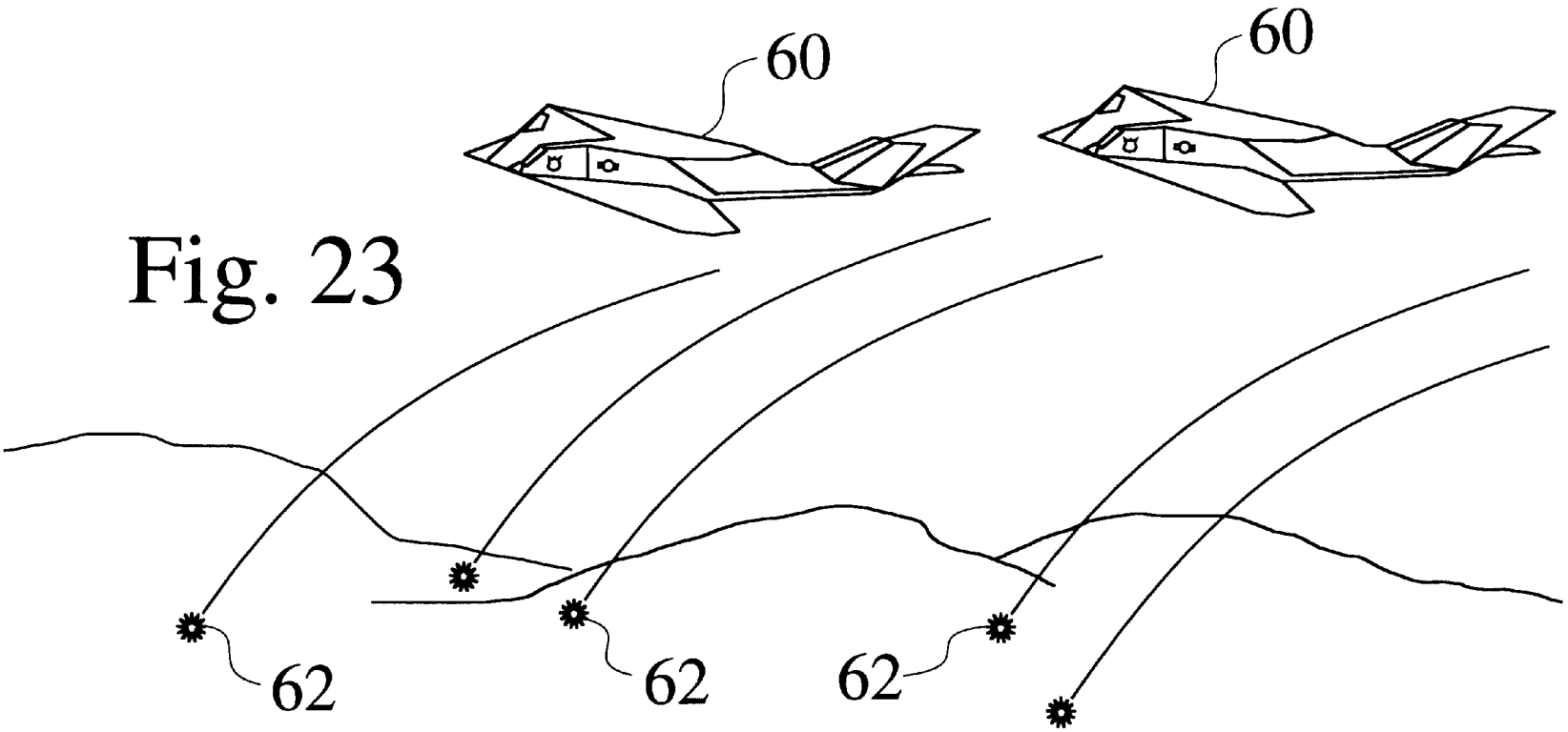

FIGS. 22, 23 and 24(*a*)–24(*c*) illustrate various uses for one of the preferred embodiments of the invention. FIG. 22 shows power lines equipped with infrared emitting diodes for supplying border patrol personnel with night vision references. FIG. 23 exhibits a method of marking a battlefield with invisible location devices. FIG. 24 reveals a method of providing IR illumination for covert landing strips.

Figure 25:
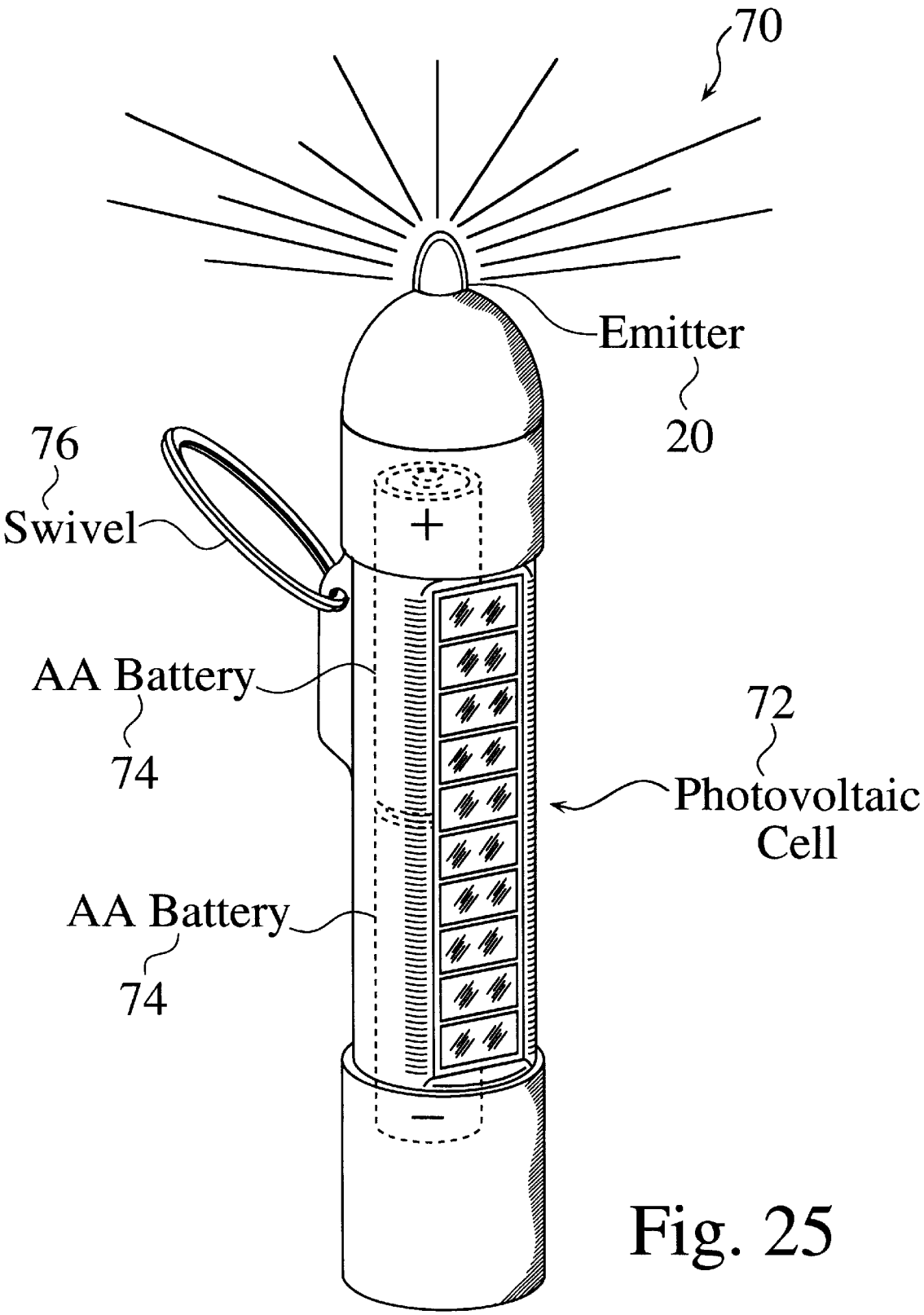

FIG. 25 shows a preferred embodiment of the invention that includes a photovoltaic cell and a swivel mount that attaches to the shoulder pack strap of a hiker or climber.

Figure 26:
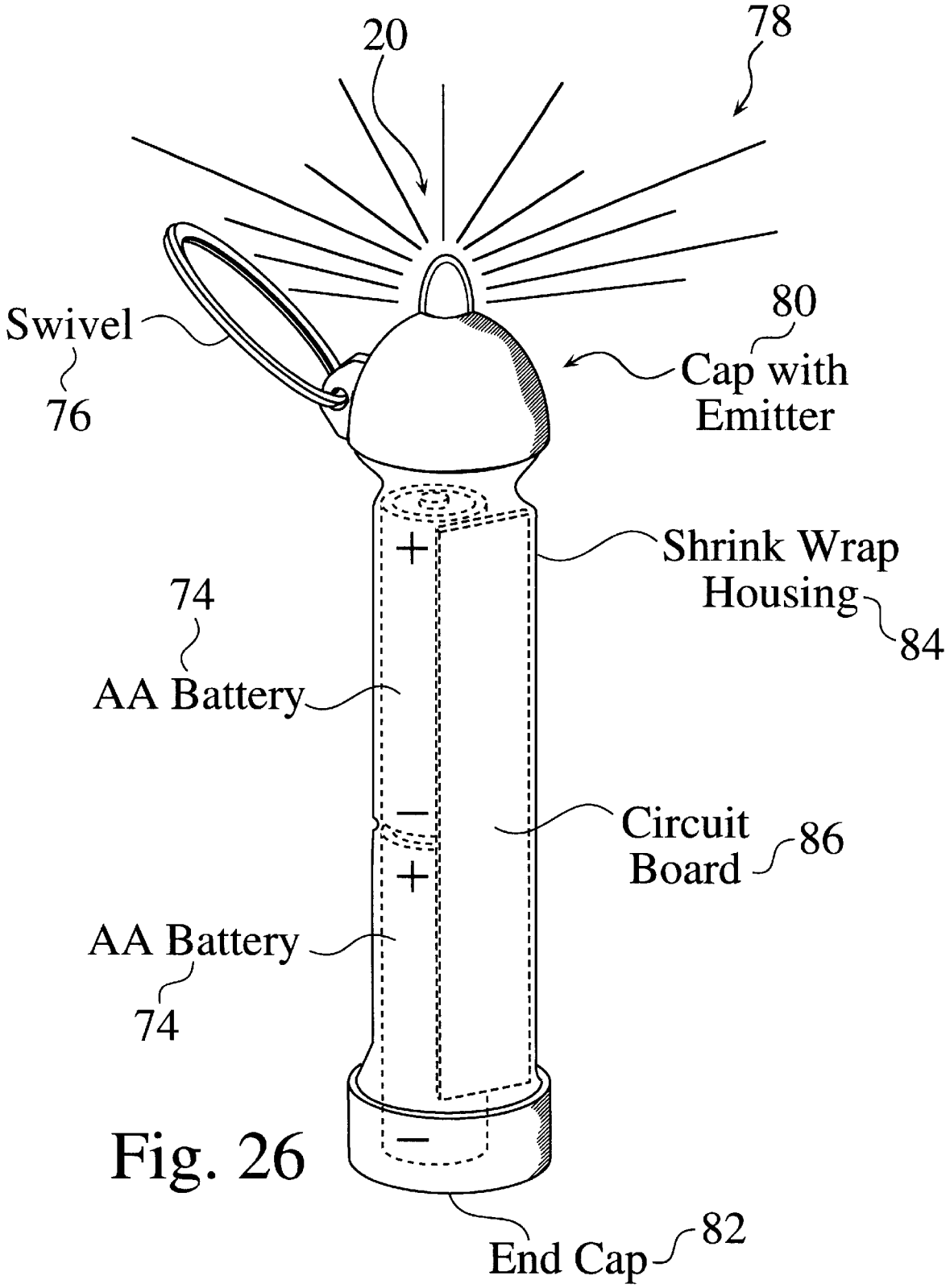

FIG. 26 shows a preferred embodiment of the invention that incorporates a shrink wrap housing over a circuit board and two batteries.

Figure 27:
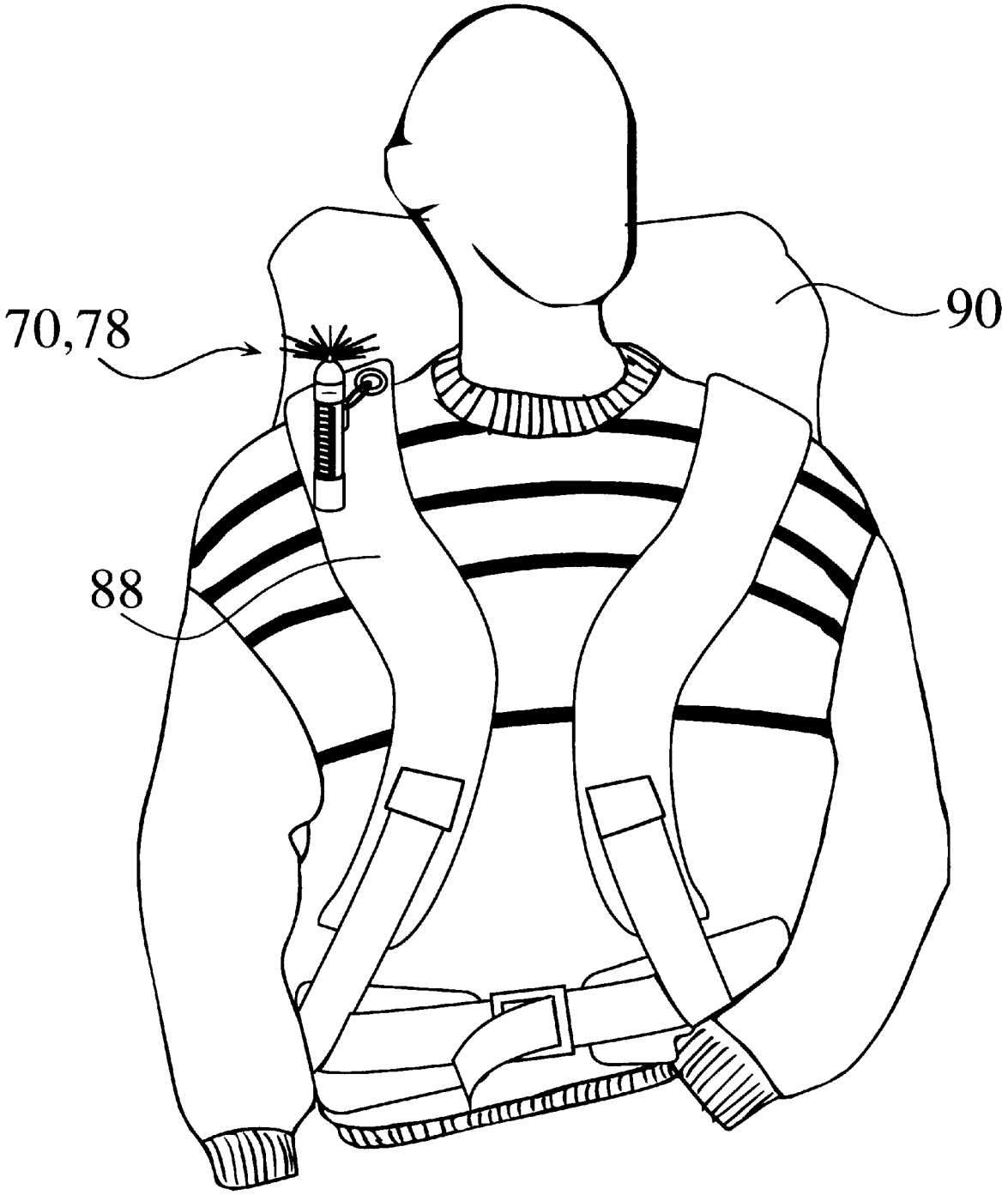

FIG. 27 is a view of a person wearing an embodiment of the invention on the strap of a backpack.

Figure 28:
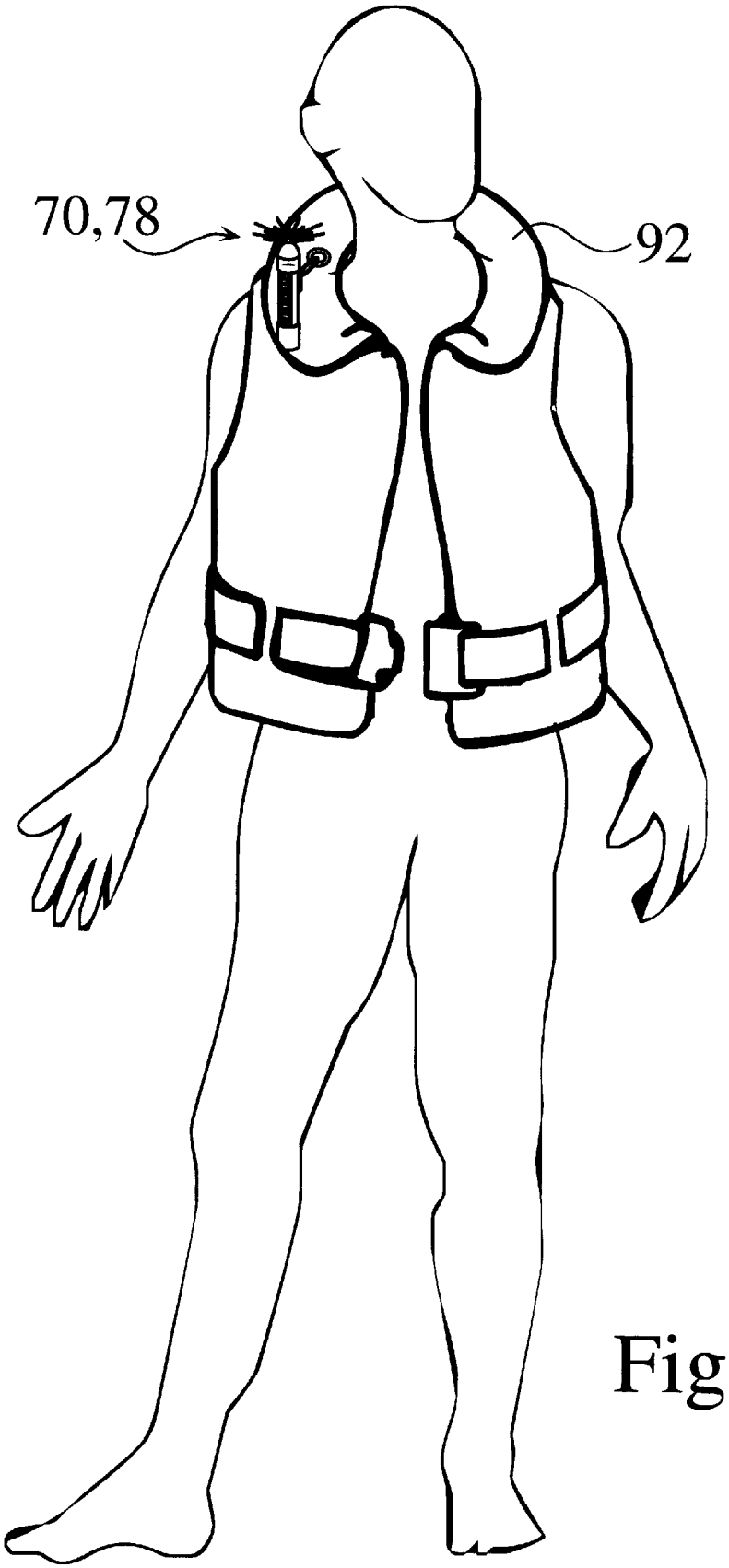

FIG. 28 portrays a person wearing one of the embodiments of the invention on a life jacket.

Figure 29:
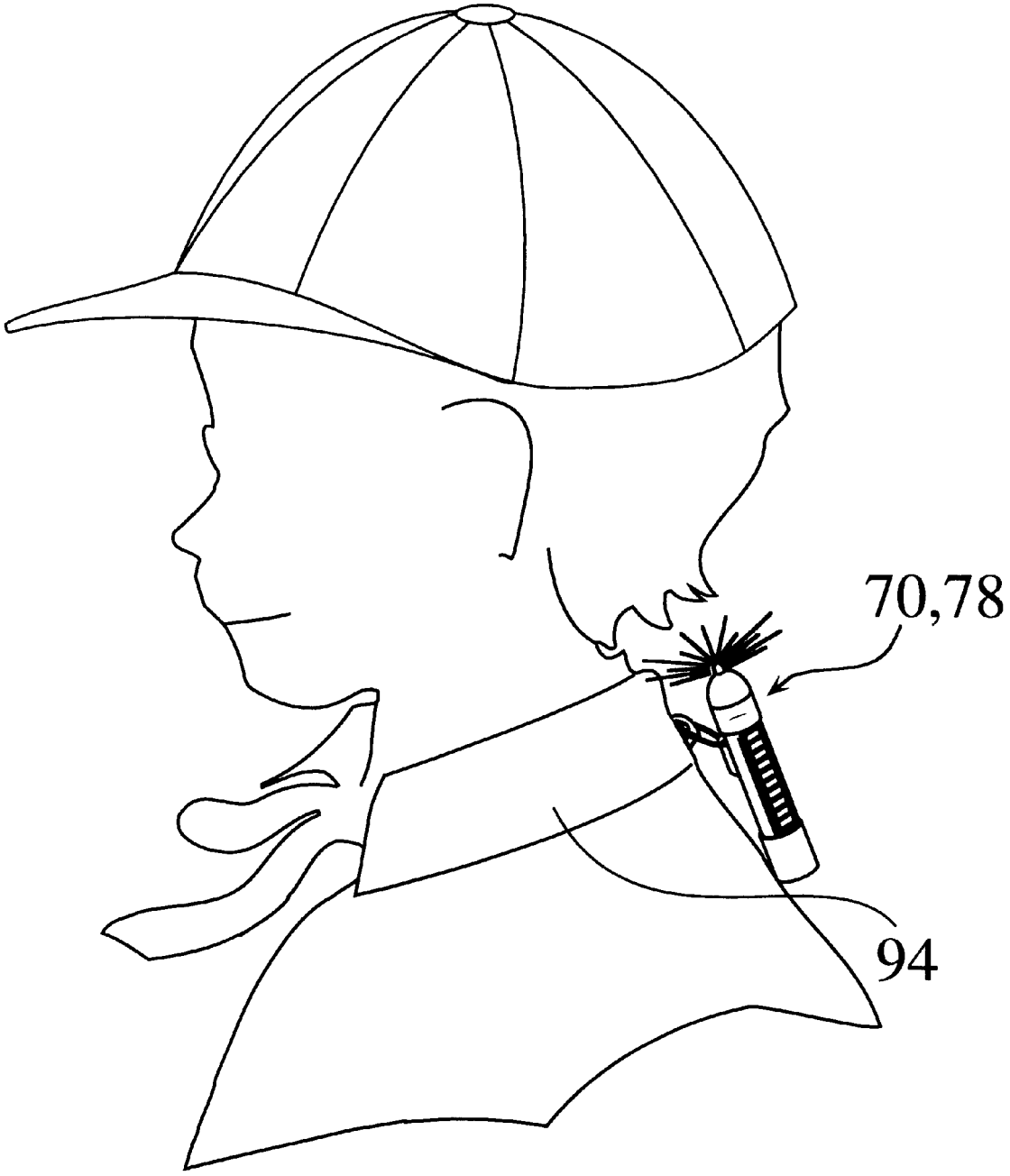

FIG. 29 furnishes a depiction of a child wearing the present invention on his or her collar.

Figure 30:
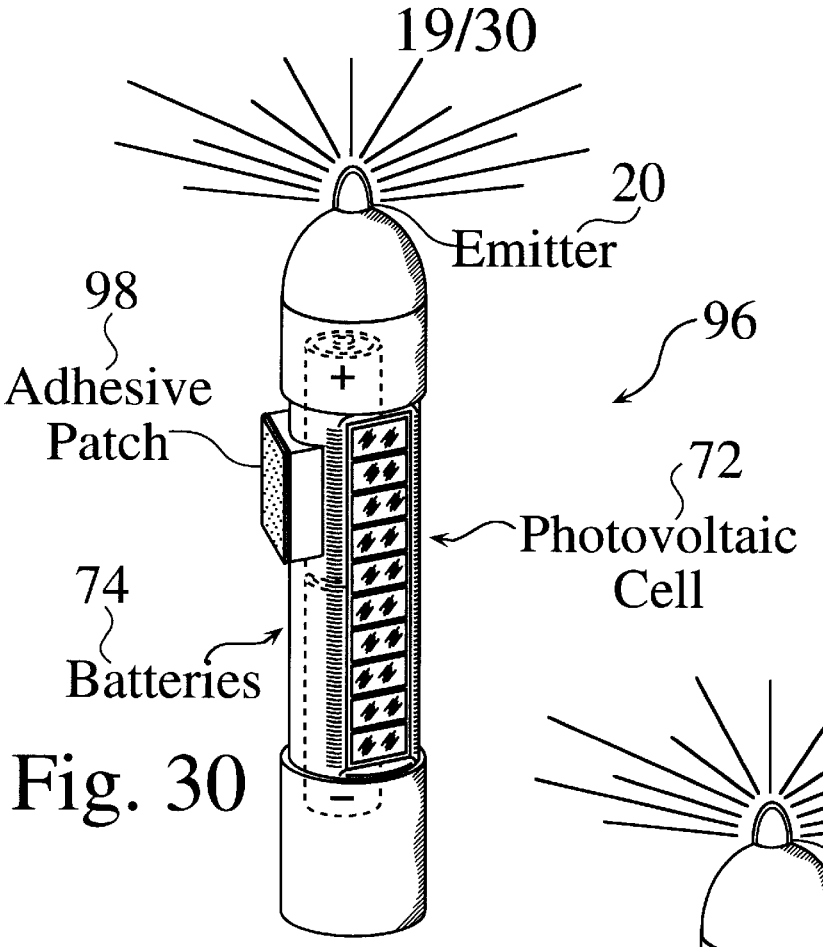
Figure 31:
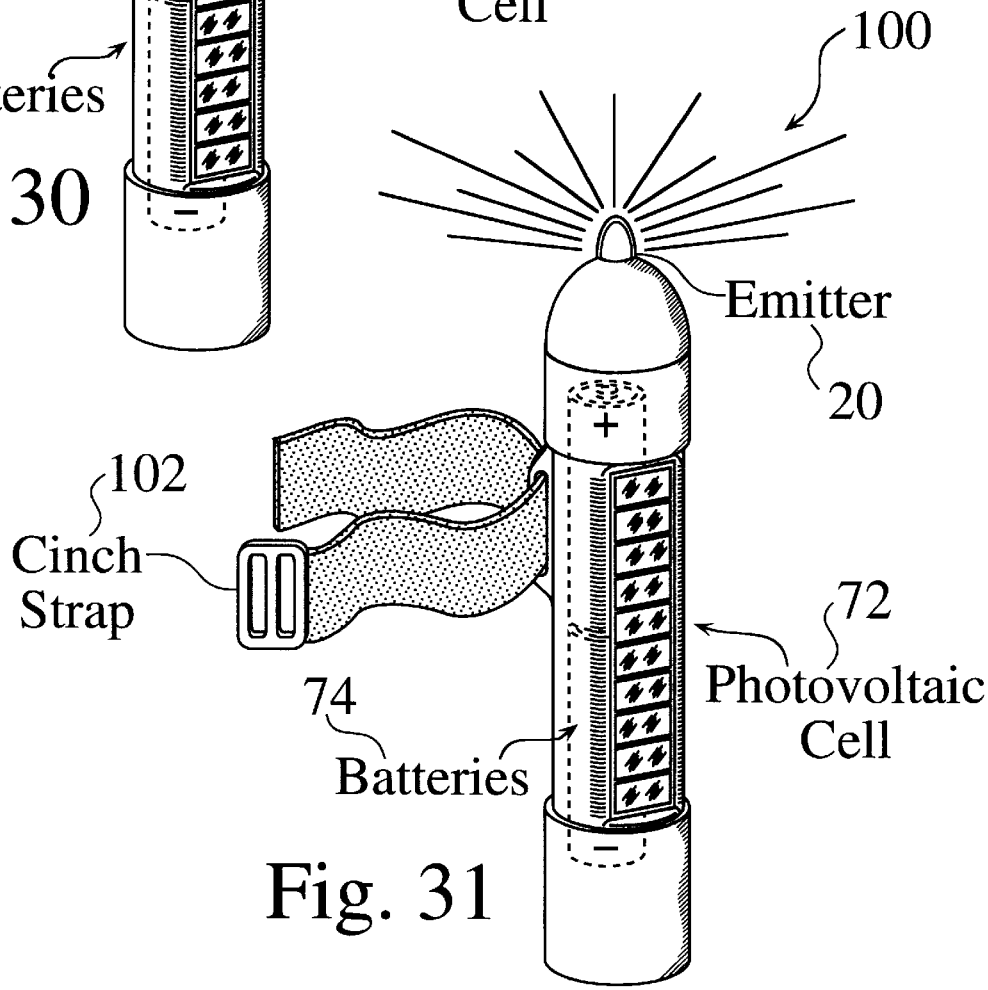

FIGS. 30 and 31 reveal alternative embodiments of the invention, which include an adhesive patch and a cinch strap for securing the invention to a person, an article of clothing or some other object.

FIGS. 32 through 41 reveal details of other embodiments of the invention.

Figure 42:
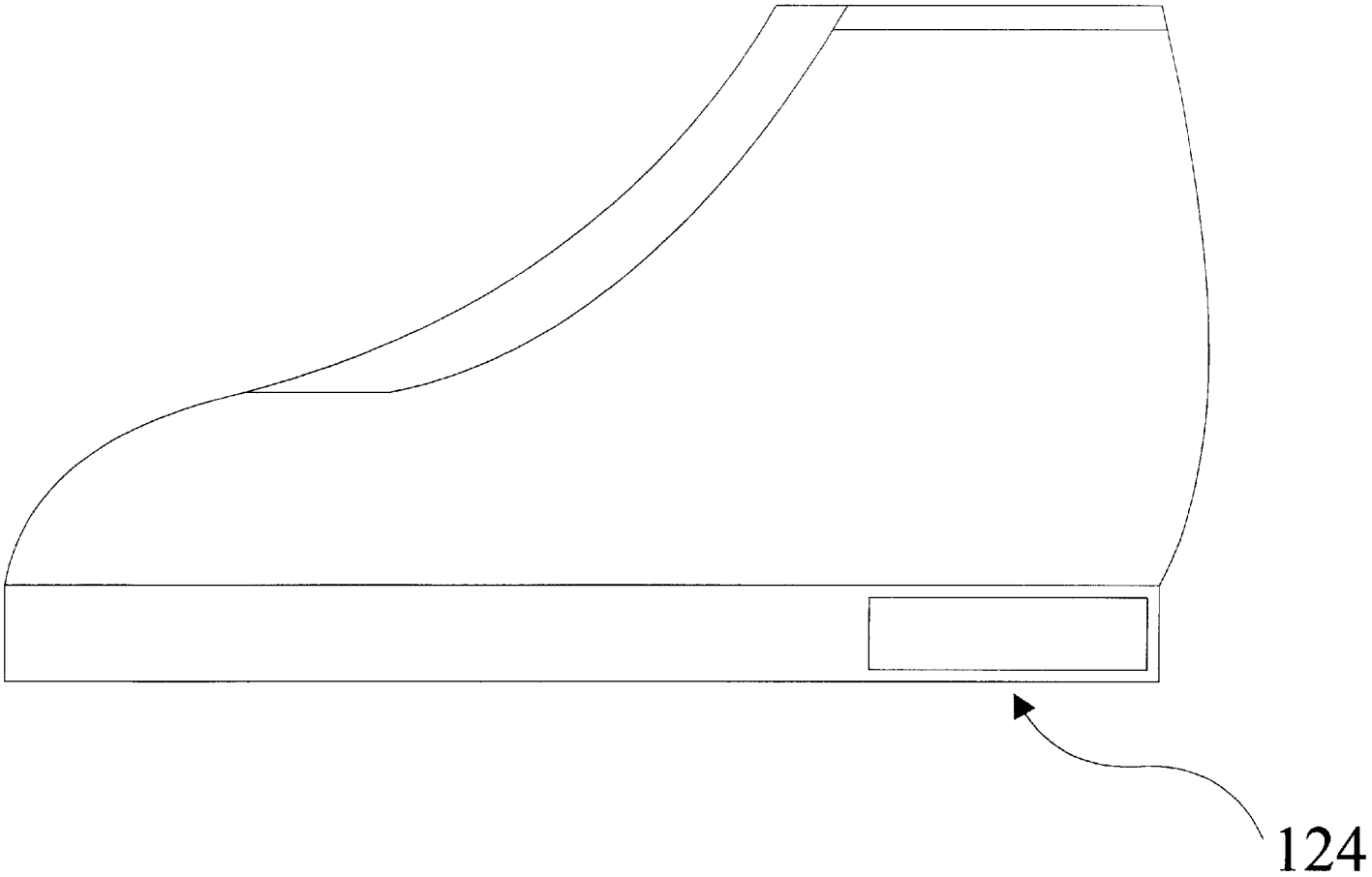

FIG. 42 shows an embodiment of the invention embedded in the sole of a shoe.

DETAILED DESCRIPTION OF PREFERRED & ALTERNATIVE EMBODIMENTS

FIG. 1 is a perspective view of a schematic depiction of one of the preferred embodiments 10 that may be employed to implement the present invention. The invention comprises a housing 12 defined by five adjacent generally rectangular faces. The housing 12 has a lower surface or end 13 and an upper surface or end 14. The lower end 13 is characterized by an opening 15 that extends toward the upper end 14. The opening 15 is particularly configured to fit over the top of a conventional nine volt battery 16. The housing 12 may be manufactured from plastic, rubber or any other suitable lightweight material that can be formed with an opening 15 designed to conform to the exterior shape of the battery 16 that is selected to be used in combination with the present invention. Although the specific embodiment 10 described below refers to the use of a nine volt dry cell 16, the invention may be practiced using combinations of housings 12 having different shapes and openings 15 and a wide variety of commercially available batteries.

A substantially oblong, generally hemispherical focusing lens 18 which is transparent to infrared radiation is integrally formed into the center of the upper surface 14 of the housing 12. A pair of positive and negative battery terminals 17*a* and 17*b* extending upward from battery 16 reside directly below focusing lens 18. An infrared emitting diode 20 that is capable of radiating energy in the infrared band 21 is also positioned below the center of the lens 18. In an alternative embodiment of the invention, a plastic vacuum-metalized reflector may be placed below the LED to achieve the widest dispersion of infrared light.

A lead 19*a* connects the positive terminal 17*a* of battery 16 to a pulse control circuit 22 through an on-off switch 24. In one of the preferred embodiments of the invention, a commercially available flasher/oscillator chip 22, such as National Semiconductor's Model No. LM3909N is used to generate a pulsing waveform that is supplied to diode 20 through lead 19*b*. Current that flows through the diode 20 flows back to the negative electrode 17*b* of battery 16 through lead 19*c*. A patch of Velcro™ brand fastening material 26 is applied to the lower portion of the battery 16. This patch 26 enables a user of the invention to fasten it to an article of clothing 42 or backpack 44 bearing another patch that receives and holds the one on the battery 16. Alternative embodiments of the adhesive patch 26 may employ an elastic loop, a buckled strap, a clip or any other suitable means for fastening the invention to a person or his or her clothing or equipment. This preferred embodiment may also include a momentary contact test switch and visible LED that allows the user to insure that the emitter is working properly.

Figure 2:
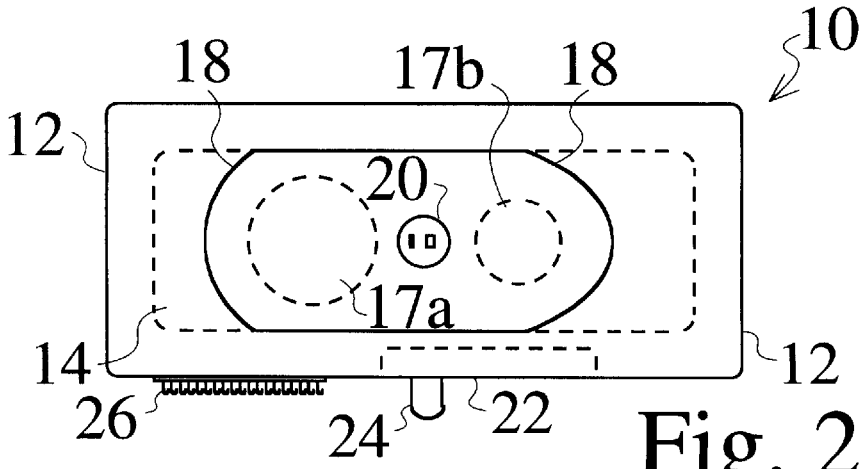

FIG. 2 presents a top view of a schematic representation of the apparatus portrayed in FIG. 1.

Figure 3:
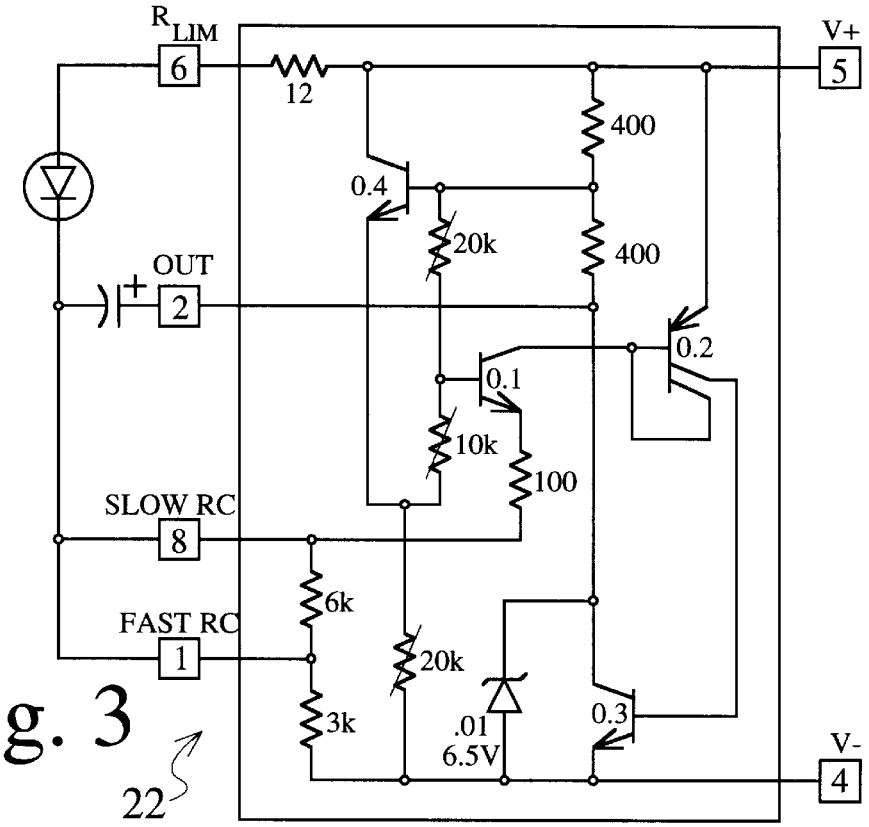

FIGS. 3 and 4 supply a schematic diagram and a pin connection diagram of a pulse control circuit 22 that may be utilized to practice the present invention. The particular component that is described in detail below is a Model No. LM3909 flasher/oscillator integrated circuit 22, manufactured by National Semiconductor of Sunnyvale, Calif. Other similar commercially available components may be used as an alternative. According to a brochure published by National Semiconductor which supplies details about the technical specifications of the LM3909, the eight lead, plastic, miniature dual in-line chip 22 is a monolithic oscillator which is designed to drive radiation emitting diodes 20. When used with a timing capacitor to boost voltage levels, this integrated circuit 22 provides pulses of two volts or more to the diode 20 while operating on a supply of 1.5 V or less. The circuit is inherently self-starting, and requires the addition of only a battery and capacitor to function as a flasher/oscillator. The manufacturer claims that the chip 22 will operate over the extended temperature range of −25° C. to +70° C. The pulse control circuit 22 has been optimized for low power drain and operation from weak batteries so that continuous operation life exceeds that expected from the battery rating. The timing capacitors used with the chip are generally electrolytic capacitors. The manufacturer also claims that a standard C size battery will operate the LM3909 and provide a high current pulse to the diode 20 for one year. Table One supplies a listing of data for the LM3909 published by National Semiconductor.

TABLE 1

LM3909 Flasher/Oscillator

Electrical Characteristics

| PARAMETER | CONDITIONS | MIN | TYP | MAX | UNITS |
|---|---|---|---|---|---|
| Supply Voltage | (In Oscillation) | 1.15 | | 6.0 | Volts |
| Operating Current | | 0.55 | 0.75 | | mA |
| Flash Frequency | 300 μF, 5% Capacitor | 0.65 | 1.0 | 1.3 | Hz |
| High Flash Frequency kHz | 0.30 μF, 5% Capacitor | | 1.1 | | |
| Compatible LED Forward Drop | 1 mA Forward Current | 1.35 | | 2.1 | V |
| Peak LED Current | 350 μF Capacitor | 45 | | | mA |
| Pulse Width | 350 μF Capacitors at ½ Amplitude | 6.0 | | | ms |

Typical Operating Conditions

| V+ | Nominal Flash Hz | $C_T$ | $R_S$ | $R_{FS}$ | $V_{\pm RANGE}$ |
|---|---|---|---|---|---|
| 6 V | 2 | 400 μF | 1 k | 1.5 k | 5–25 V |
| 15 V | 2 | 180 μF | 3.9 k | 1 k | 13–50 V |
| 100 V | 1.7 | 180 μF | 43 k | 1 k | 85–200 V |
| 100 V | 1.7 | 180 μF | 1 W | 1 k | 85–200 V |

Absolute Maximum Ratings

| | |
|---|---|
| Power Dissipation | 500 mW |
| V+ Voltage | 6.4 V |
| Operating Temperature Range | −25° C. to +70° C. |

Estimated Battery Life for Continuous 1.5 V Flasher Operation

| Size | Standard Cell | Alkaline Cell |
|---|---|---|
| AA | 3 months | 6 months |
| C | 7 months | 15 months |
| D | 1.3 years | 2.6 years |

Figure 5:
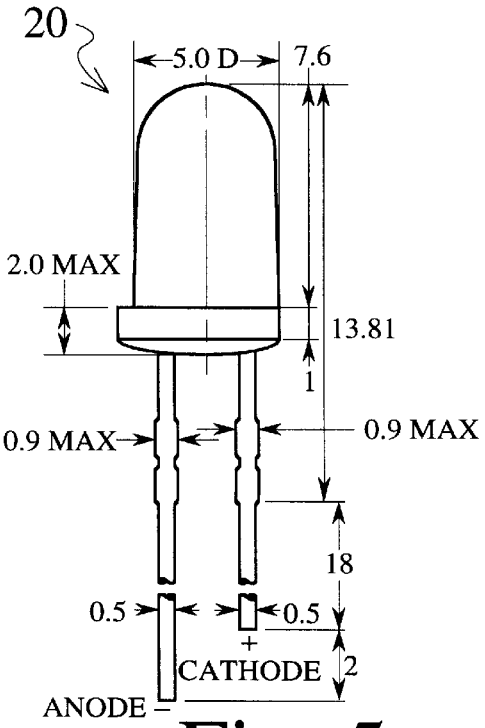
FIG. 5 is a side view of an infrared emitting diode that may be incorporated into the device shown in FIG. 1.
Figure 6:
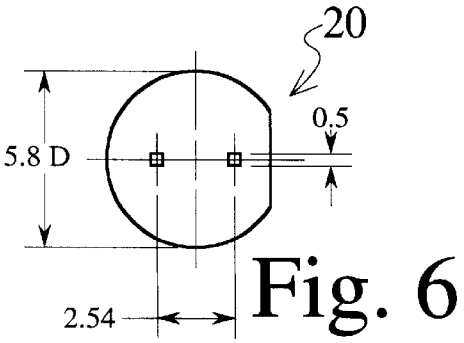
FIG. 6 is a bottom view of the infrared emitting diode illustrated in FIG. 5.

FIG. 5 depicts an infrared emitting diode 20 in a side view. This diode is incorporated into the device shown in FIG. 1. FIG. 6 is a bottom view of the same diode 20.

FIG. 7 is a graph 28 comparing input voltage and typical current drain in milliamps for a 1.5 volt flasher circuit 22, which is shown in FIG. 8. This circuit configuration is employed when the nine volt battery 16 shown in FIG. 1 is replaced with standard AA, AAA, C or D cells. A miniature version of the preferred embodiment may be constructed using watch batteries. When these other batteries 16 are used, the flexible plastic or rubber housing 12 must be molded to conform to different size cylindrical shapes or combinations of cylindrical shapes when more than one battery 16 is used at once. For the arrangement shown in FIG. 8, the nominal flash rate is one flash per second (1 Hz). Various flash rates may be obtained by varying the input voltage to the chip 22 and by using an electrolytic capacitor having a higher or a lower value between pins 1 and 2. The preferred time duration for the flash for the preferred embodiment is a short "on" pulse that has a duration of about one half of one second. The "off" period that runs between the "on" pulses lasts about five seconds.

FIG. 9 is a graph 30 that shows the intensity or brightness of the infrared radiation emitted by diode 20 for a given distance away from the diode 20.

Test data for diode 20 is presented by FIGS. 10, 11, 12 and 13. FIG. 10 reveals a graph of radiation output in milliwatts versus forward current in milliamps. FIG. 11 is a graph 34 that compares relative radiation output in percent and ambient temperature in degrees Celsius. FIG. 12 is a graph 36 which characterizes the directional radiation pattern emitted by the diode. FIG. 13 provides a plot 38 of relative radiation output in percent versus wavelength.

The specific component employed as diode 20 that is described below is the Model No. KMTL2040, manufactured by KCK America Incorporated of Des Plaines, Ill. The manufacturer describes this product as a gallium arsenide (GaAs) liquid phase epitaxial infrared emitting diode of 05 resin mold type. The technical specifications for this diode that are published by KCK are summarized below:

TABLE 2

KMTL2040 IR Diode

Absolute Maximum Ratings (Ta = 25° C.)

| Ratings | Symbol | Standard | Unit |
|---|---|---|---|
| Forward Current | $1_F$ | 100 | mA |
| Pulse Forward Current*1 | $1_{FP}$ | 1 | A |
| Reverse Voltage | $V_R$ | 5 | V |
| Power Dissipation | $P_D$ | 100 | mW |
| Operational Temperature | $T_{opr}$ | −30~+70 | ° C. |
| Storage Temperature | $T_{stg}$ | −30~+70 | ° C. |
| Soldering Temperature*2 | $T_{sold}$ | 260 | ° C. |

Electro-Optical Characteristics (Ta = 25° C.)

| Ratings | Symbol | Conditions | MIN | TYP | MAX | Unit |
|---|---|---|---|---|---|---|
| Forward Voltage | $V_F$ | IF = 100 mA | 1.4 | 1.6 | V | |
| Reverse Current | $I_R$ | $V_R$ = 5 V | | | 10 | μA |
| Radiation Output | $P_o$ | $I_F$ = 100 mA | | 5 | | mW |
| Peak Wavelength | $\lambda_p$ | $I_F$ = 50 mA | | 940 | | nm |
| Spectral Bandwidth at 50% | $\Delta\lambda$ | $I_F$ = 50 mA | | 50 | | nm |
| Half Angle | $\Delta\theta$ | | | ±25 | | deg |

*1 Pulse Bandwidth: Tw = 100 μs
Repetition Cycle: T = 10 ms
*2 t = 5 sec, L = 2 mm

A BRIEF DESCRIPTION OF ADDITIONAL APPLICATIONS OF THE INVENTION

FIGS. 14 and 15 show the present invention attached to a cap 40, and to various articles of clothing 42. FIGS. 16 through 21 illustrate one preferred embodiment of the present invention in the context of specific applications. FIG. 16 shows the invention attached to a backpack 44; FIG. 17 is an illustration of the invention formed into the top of a ski pole 46; FIG. 18 offers a view of the invention mounted on the rear fenders of a racing auto 48; FIG. 19 reveals emitters affixed to a boat 50; FIG. 20 shows how the invention may be employed with a passenger car 52; and FIG. 21 is a depiction of the invention installed on an inflatable life boat 54.

Figures 24A, 24B, 24C:
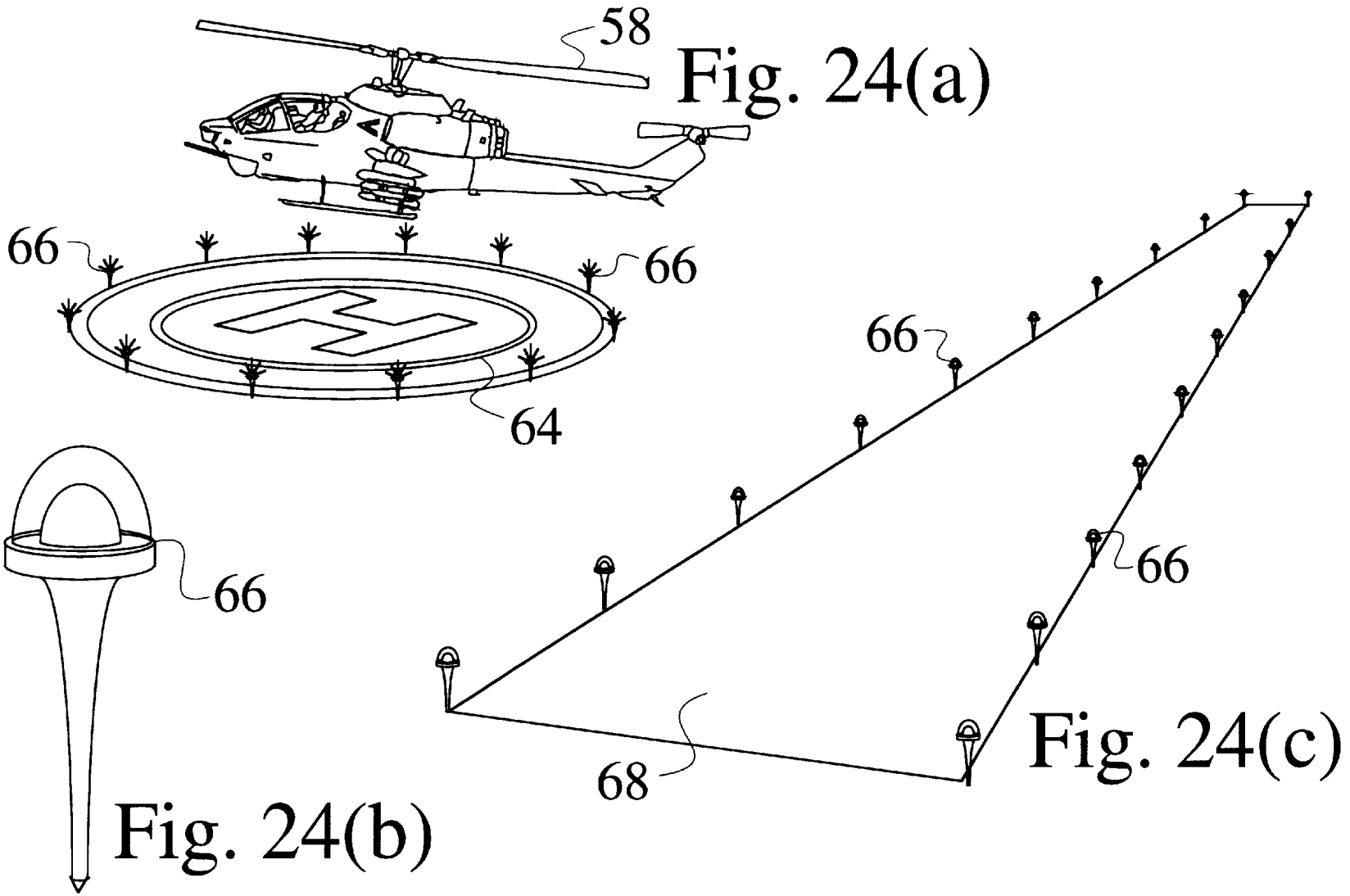

FIGS. 22, 23 and 24 illustrate various uses for the present invention. FIG. 22 shows power lines 56 borne by towers 57 equipped with infrared emitting diodes 10 for supplying border patrol personnel in a helicopter 58 with night vision references. FIG. 23 illustrates two aircraft 60 marking a battlefield with invisible location devices 62. FIG. 24*a* shows a helicopter 58 landing on a helipad 64 marked with IR landing guides 66. FIG. 24*b* exhibits an enlarged view of a landing guide 66. FIG. 24*c* reveals a landing strip 68 illuminated by IR landing guides 66.

FIG. 25 reveals a preferred embodiment 70 of the invention which incorporates a photovoltaic cell 72 that maintains an electrical charge on rechargeable AA batteries 74. A swivel ring 76 attached near the emitter 20 is used to couple the invention to a person, an article of clothing or some other object. The swivel 76 is mounted so that if the person wearing the invention should fall and become incapacitated, then the weight of the device below the swivel 76 causes the lower end of the invention to rotate toward the ground, keeping the emitter 20 pointed upwards toward the line of sight of a rescuer.

FIG. 26 reveals yet another embodiment of the invention 78, which comprises a top cap 80 including an emitter 20 and a lower end cap 86 fitted over a housing 84 found from an encapsulating material such as potting. The housing 84 encloses batteries 74 and a circuit board 86. A swivel ring 76 is coupled to the top cap 80.

FIGS. 27, 28 and 29 portray specific applications for the various embodiments of the invention. FIG. 27 furnishes a view of a person wearing the invention 70,78 on the strap 88 of a backpack 90, FIG. 28 shows the invention 70, 78 fastened to a life jacket 92 and FIG. 29 exhibits the invention 70, 78 clipped to the collar 94 of a child's shirt.

FIGS. 30 and 31 supply views of alternative embodiments of the invention. FIG. 30 provides a rendering of an embodiment 96 that incorporates an adhesive patch 98 for coupling the invention to a person, an article of clothing or some other object. FIG. 31 offers a portrayal of an embodiment 100 that utilizes a cinch strap 102 for connection to a person's arm, a belt or some other object.

Figure 32:
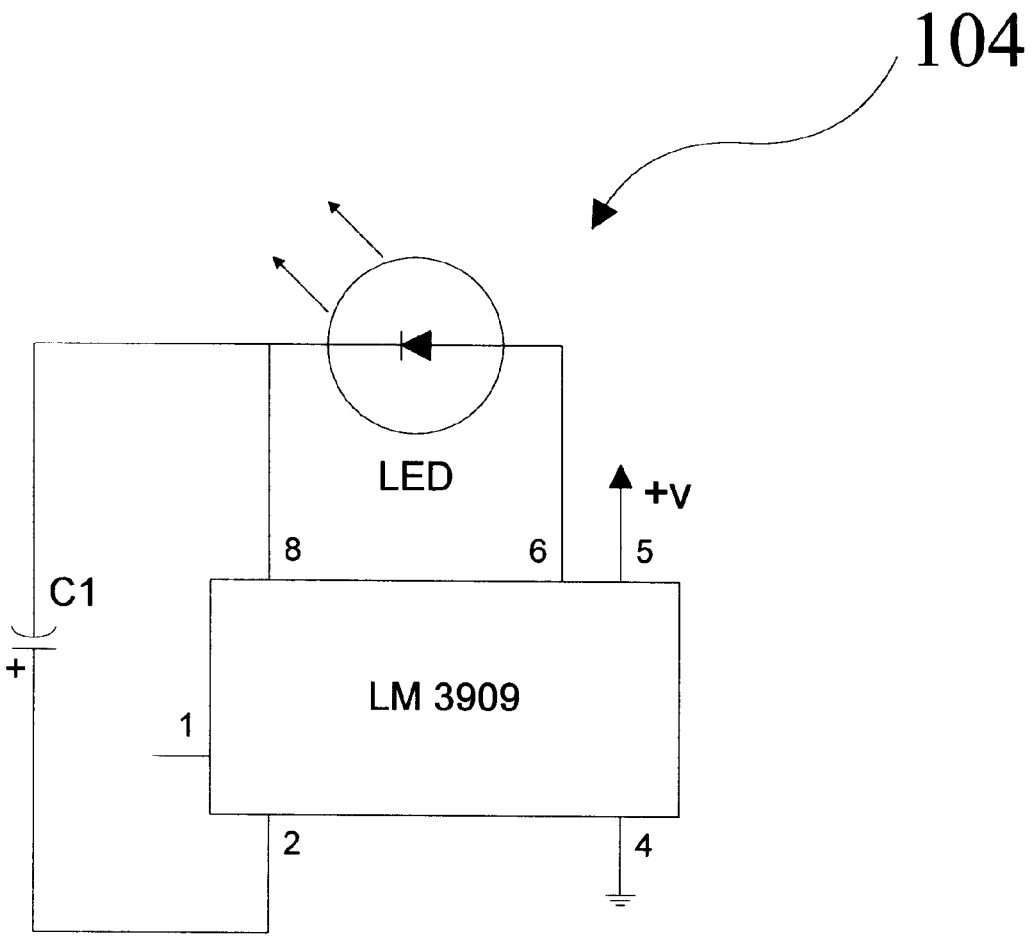

FIG. 32 shows a preferred embodiment of the disclosed invention based upon a LM3909 Integrated Circuit (IC). The supply voltage is 1.5 volts (1.5 v) typically supplied by a AA battery. Capacitor C1 controls the pulse rate; a lower C1 value increases the pulse rate. A preferred embodiment uses a C1 of 47 micro farads (47 $\mu$F).

Figure 33:
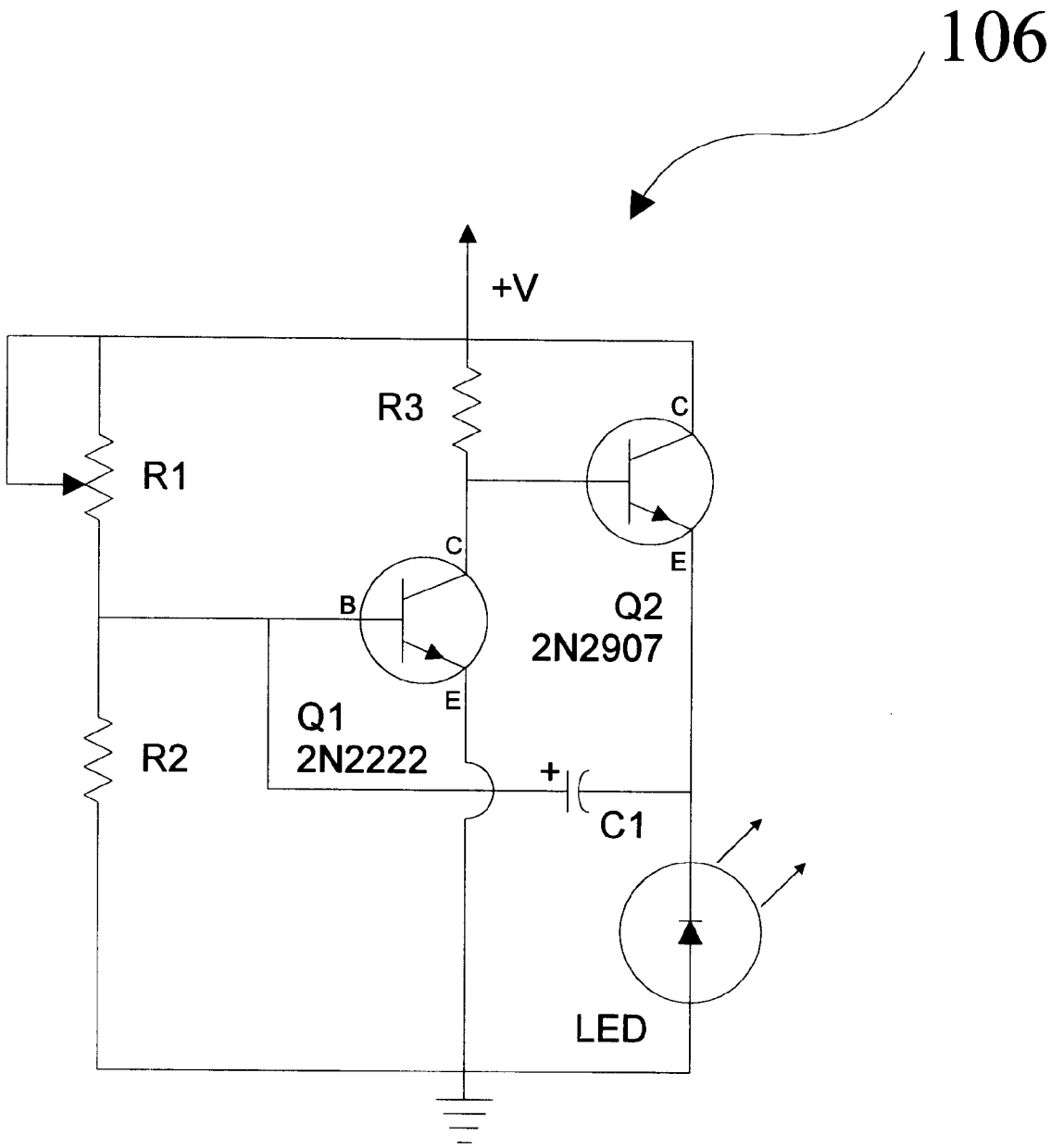

FIG. 33 shows an alternative embodiment of the disclosed invention which utilizes two transistors to produce bright flashes of the light emitting diode (LED). The transistors Q1 is a 2N2222 and Q2 is a 2N2907. The supply voltage can range from 6 to 9 v. In this embodiment capacitor C1 has a value of 22 micro farads (22 $\mu$F). Resistor R1 controls the pulse rate and has a value of one hundred thousand ohms (100 kΩ). N R2 and R3 are respectively 5.6 kΩ and 1 kΩ.

Figure 34:
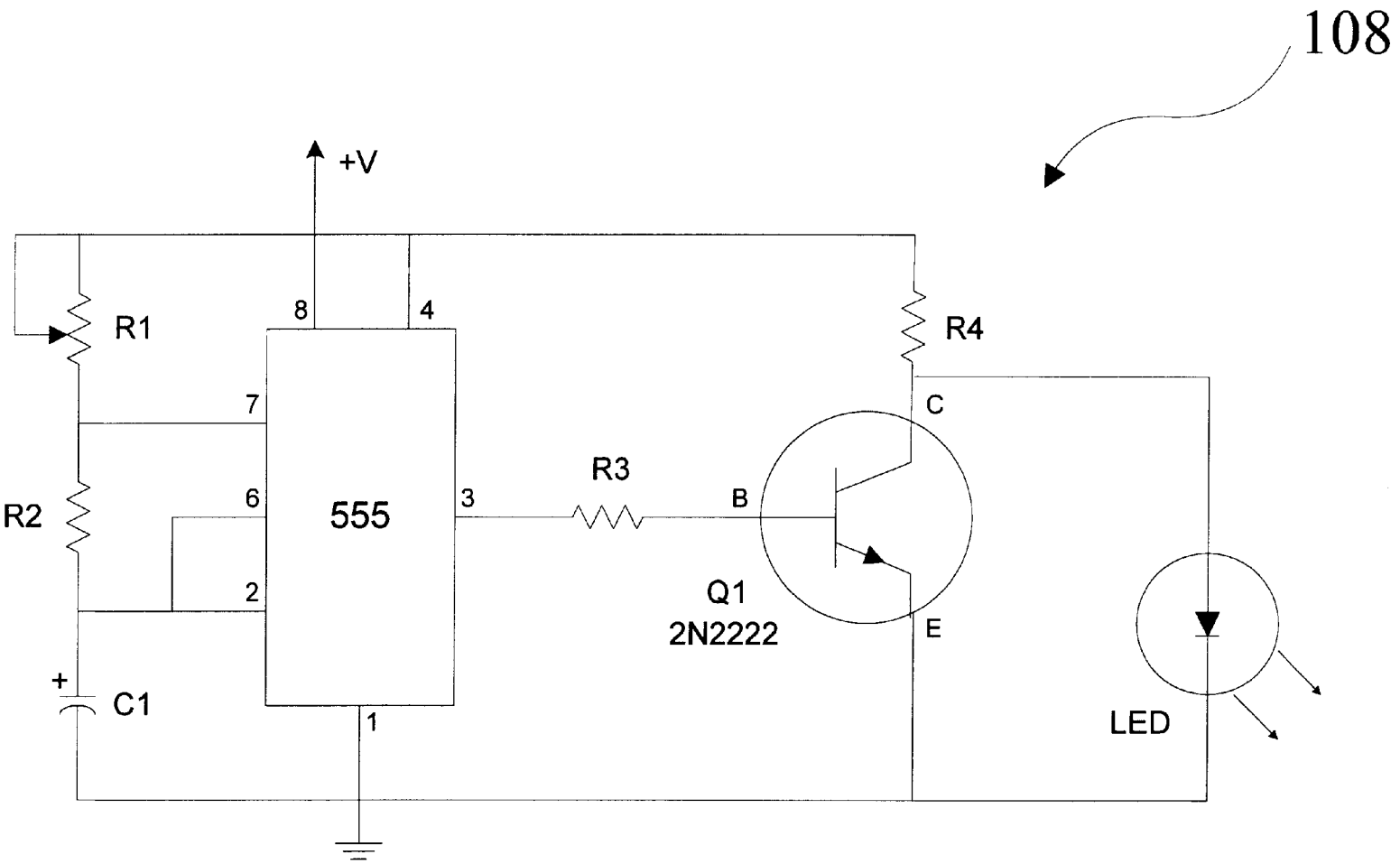

FIG. 34 shows an alternative embodiment of the disclosed invention based upon a 555 Timer IC. The supply voltage is 9 v. Transistor Q1 is a 2N2222. Resistors R2, R3 and R4 are respectively 1 kΩ, 1 kΩ and 270 Ω. Resistor R1 combined with capacitor C1 control the pulse rate; a lower C1 value increases the pulse rate. In the instant embodiment C1 has a value of 47 $\mu$F. The following R1 values yield the pulse rate shown:

| R1 | Pulse Rate |
|---|---|
| 100 kΩ | 0.2 Hz |
| 47 kΩ | 0.6 Hz |
| 22 kΩ | 1.1 Hz |
| 10 kΩ | 2.1 Hz |
| 4.7 kΩ | 3.6 Hz |
| 2.2 kΩ | 6.1 Hz |
| 1 kΩ | 8.3 Hz |

Figure 35:
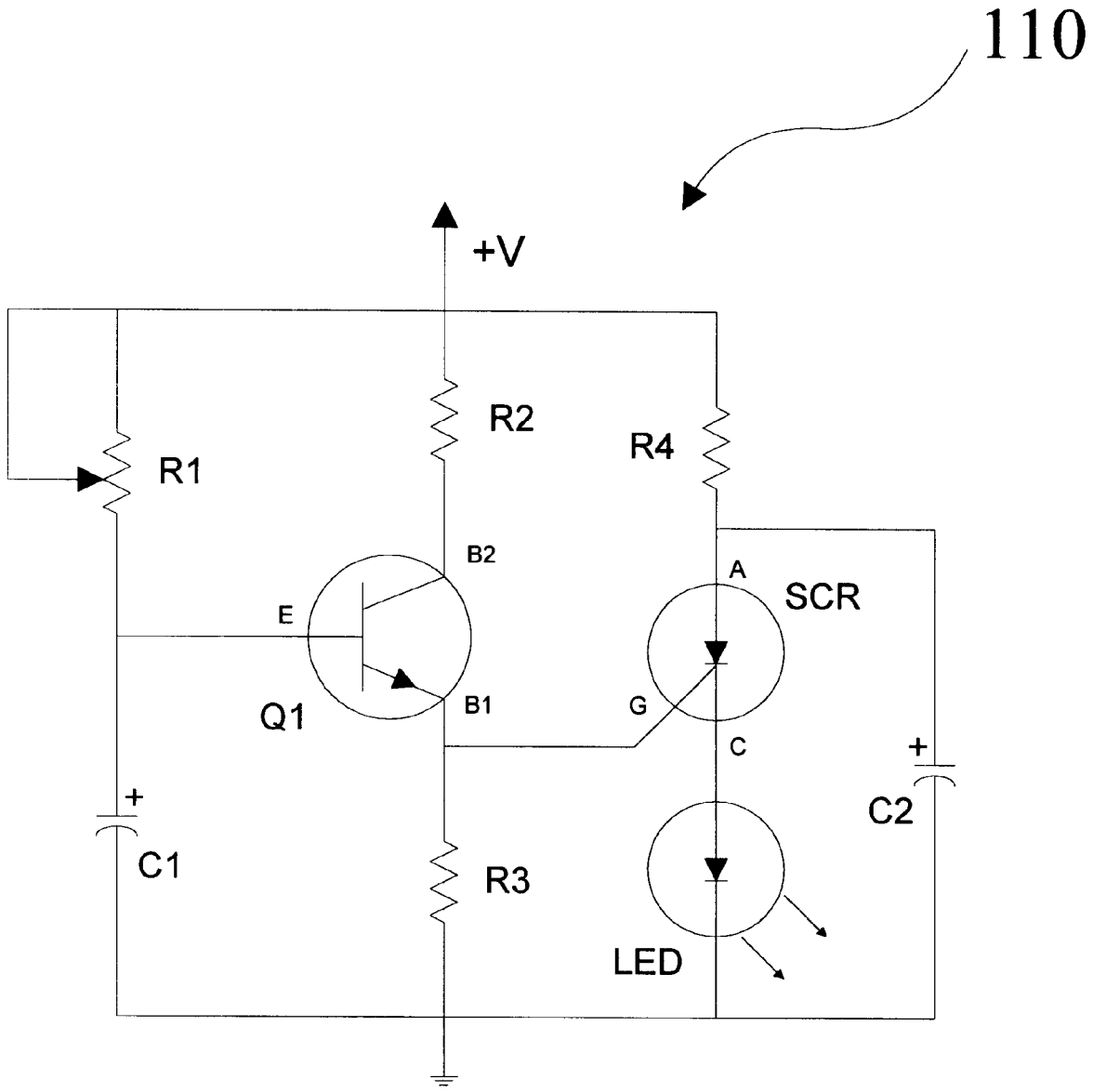

FIG. 35 shows an alternative embodiment of the disclosed invention which utilizes the discharging of a capacitor to flash the LED. Supply voltage is 9 v. Transistor Q1 is a 2N4891 UJT. The circuit also utilizes a Silicon Control Rectifier, SCR. Capacitors C1 and C2 have the same value 22 $\mu$F. Resistor R1 controls the pulse rate and has a value of 100 Ω. R2, R3 and R4 are respectively, 100 Ω, 100 Ω and 5.6 kΩ.

Figure 36:
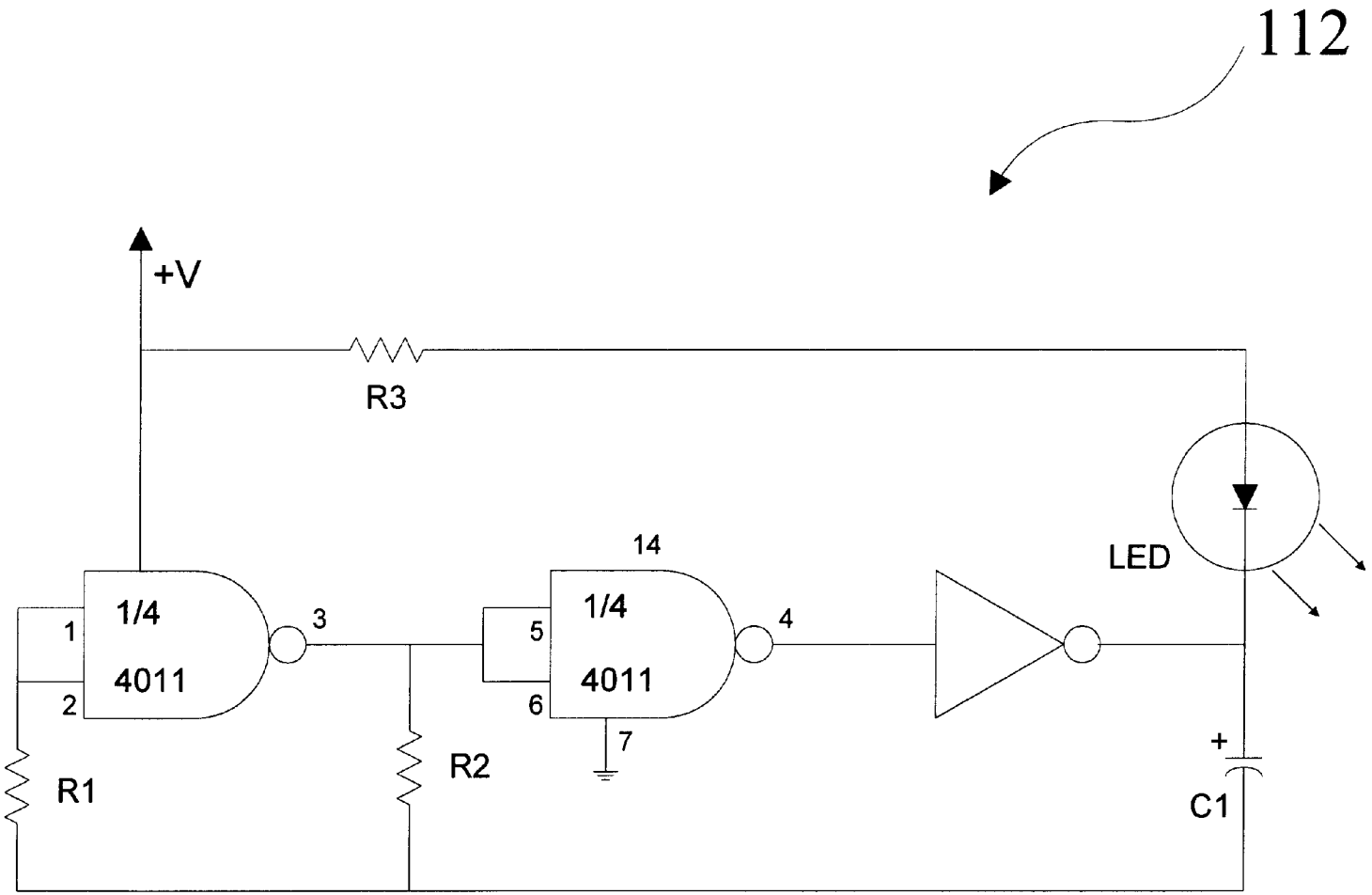

FIG. 36 shows an alternative embodiment of the disclosed invention which utilizes two 4011 operational amplifiers (Op Amps) CMOS1 and CMOS2 and an inverter to pulse the LED. Resistors R1, R2 and R3 are respectively 1 MΩ, 100 kΩ and 1 kΩ. Capacitor C1 controls the pulse rate; a lower C1 value increases the pulse rate. Here C1 is 4.7 $\mu$F.

Figure 37:
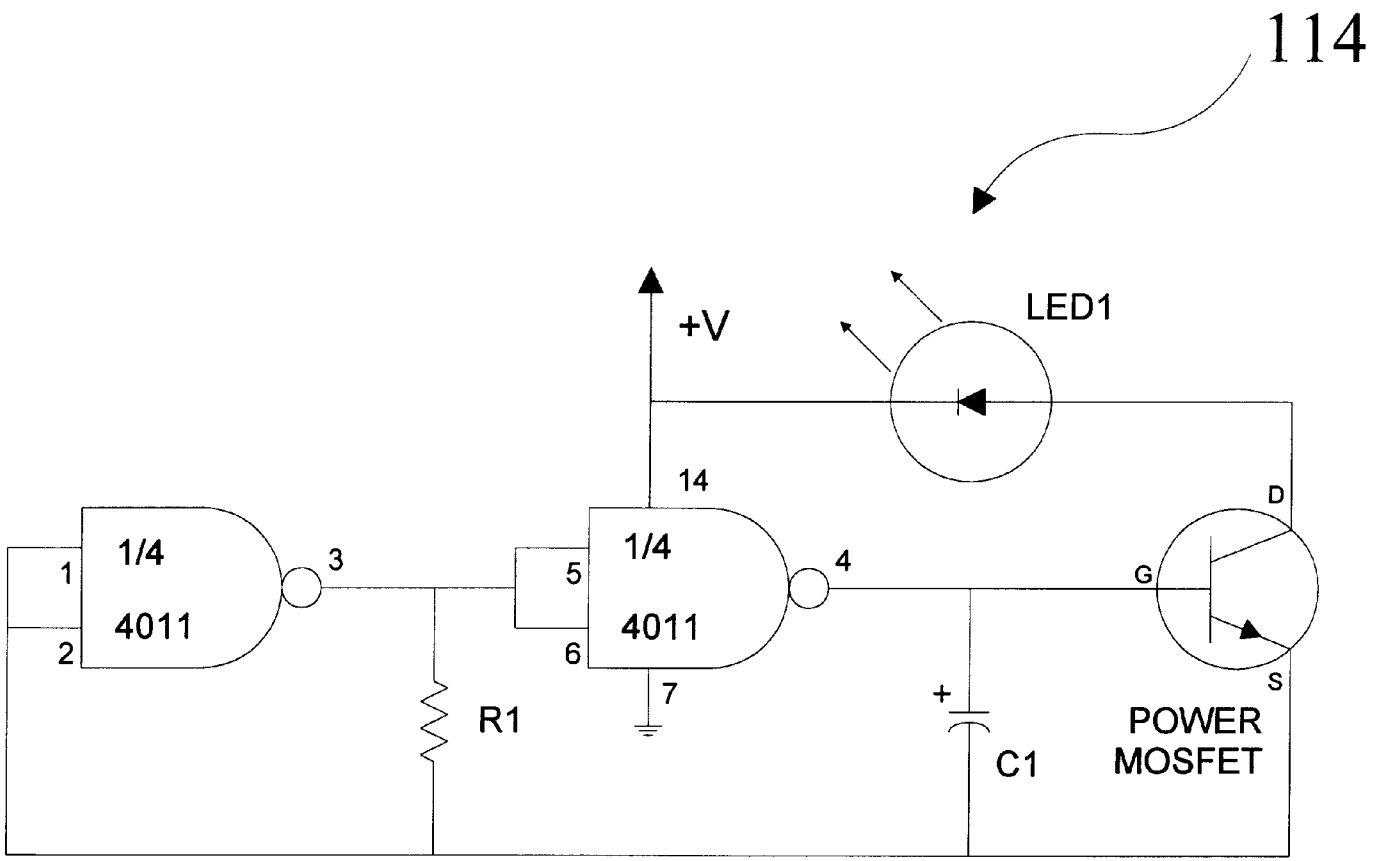

FIG. 37 shows an alternative embodiment of the disclosed invention which combines a power MOSFET with two 4011 Op Amps to pulse the LED. Capacitor C1 and resistor R1 control the pulse rate; reduce the value of C1 for faster pulse rates. Here C1 is 4.7 $\mu$F and R1 is 100 kΩ which yields a pulse rate of 1 Hz.

Figure 38:
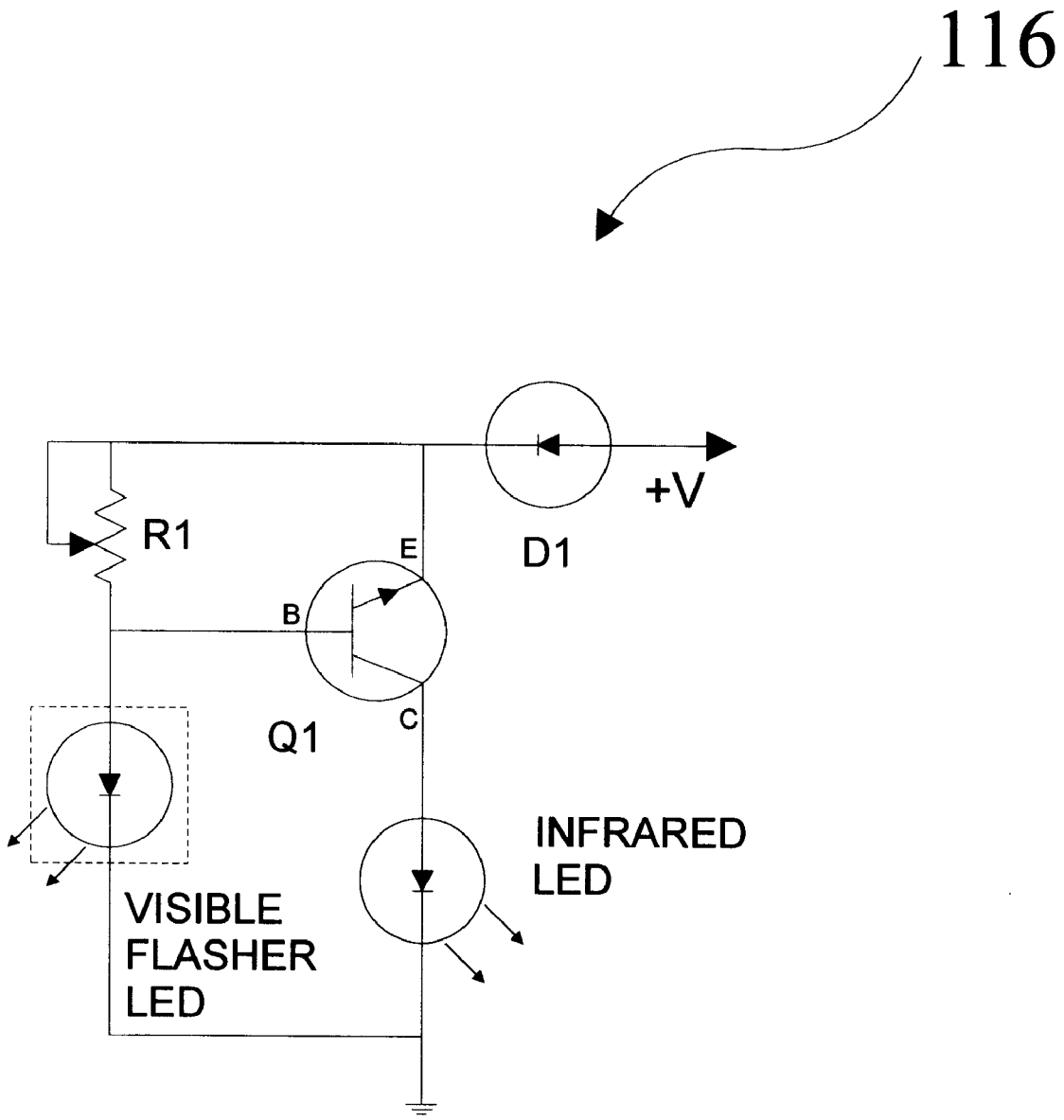

FIG. 38 shows an alternative embodiment of the disclosed invention which uses a flasher LED, that is, an LED that contains a pulsing circuit, to drive another LED. The supply voltage is 6 v. Transistor Q1 may be either a 2N2907 or a 2N3906. Diode D1 is a 1N914. Resistor R1 controls the flash rate and here has a value of 100 kΩ.

Figure 39:
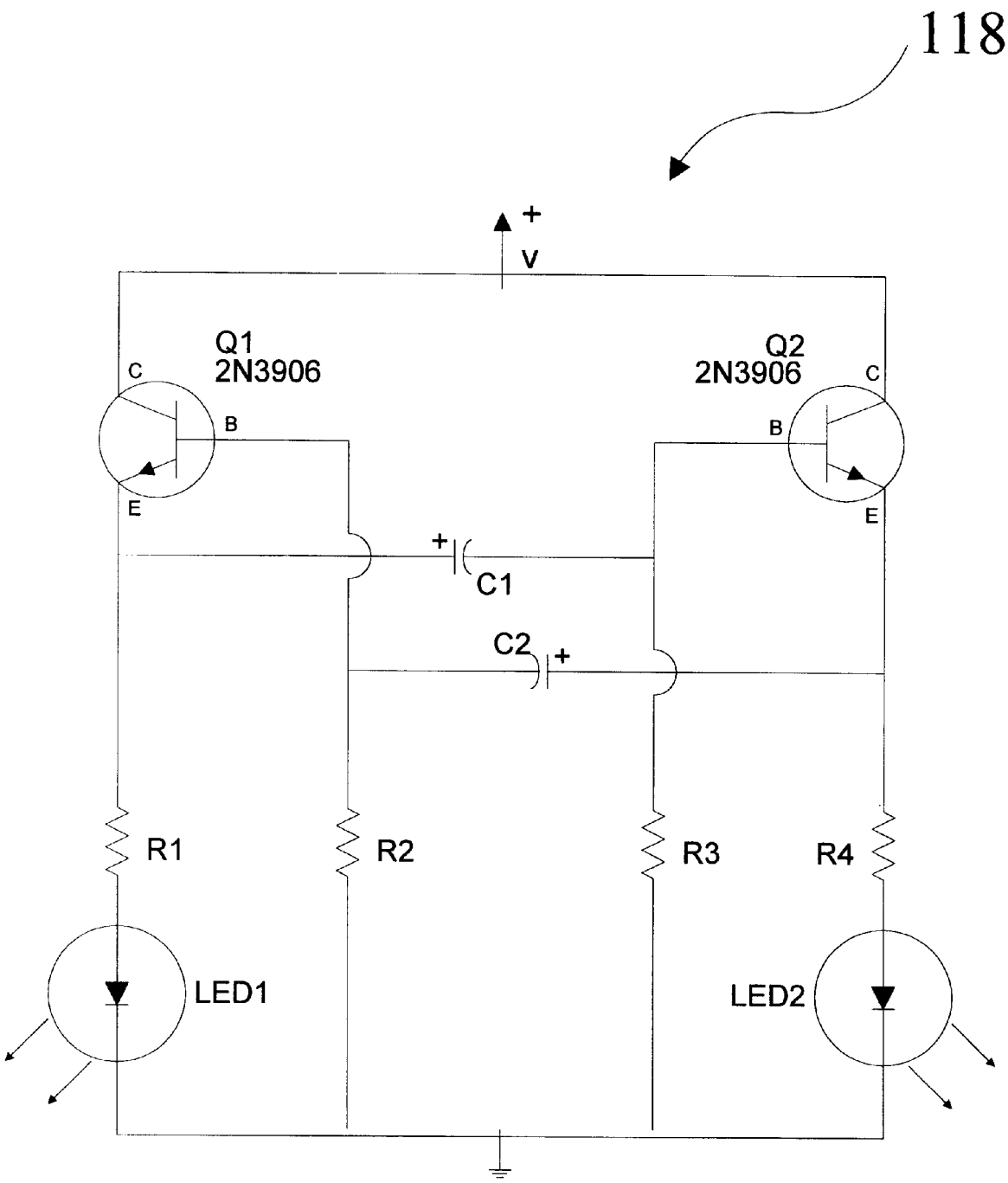

FIG. 39 shows an alternative embodiment of the disclosed invention which uses two transistors Q1 and Q2, both 2N3906, to pulse two LEDs. The supply voltage is 3 v to 9 v. Capacitors C1 and C2 control the pulse rate; reduce the values of either or both to increase the pulse rate. Here C1 and C2 are both 47 $\mu$F.

Resistors R1 through R4 are respectively 220 Ω, 100 kΩ, 100 kΩ and 220Ω.

Figure 40:
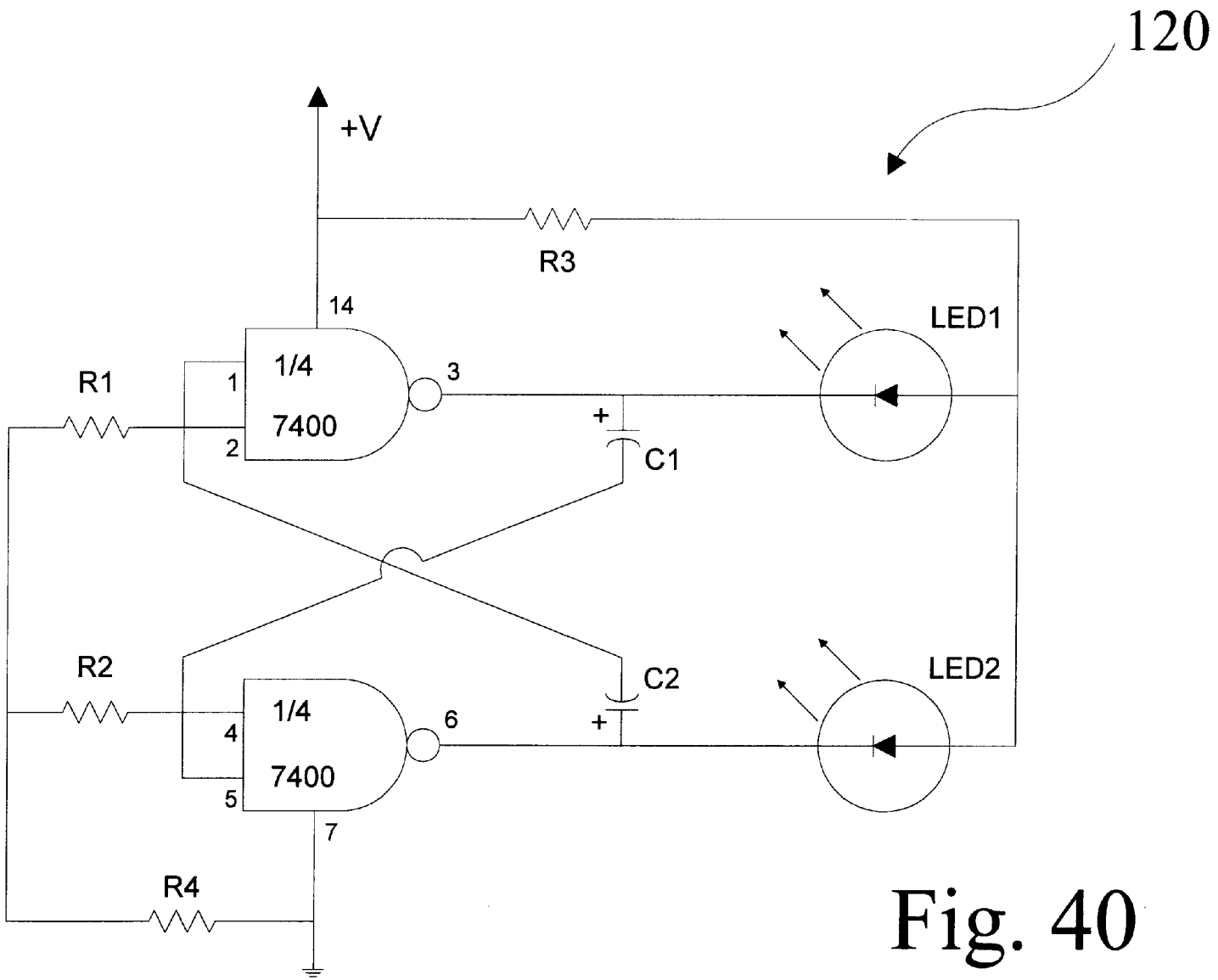

FIG. 40 shows an alternative embodiment of the disclosed invention which uses two 7400 Op Amps IC1 and IC to pulse two LEDs. The supply voltage is 5 v. Capacitors C1 and C2 control the pulse rate; reduce the values of either or both to increase the pulse rate. Here C1 and C2 are both 47 $\mu$F, yielding a 2 Hz pulse rate. Resistors R1 through R4 are respectively 4.7 kΩ, 4.7 kΩ, 470 Ω and 1 kΩ.

Figure 41:
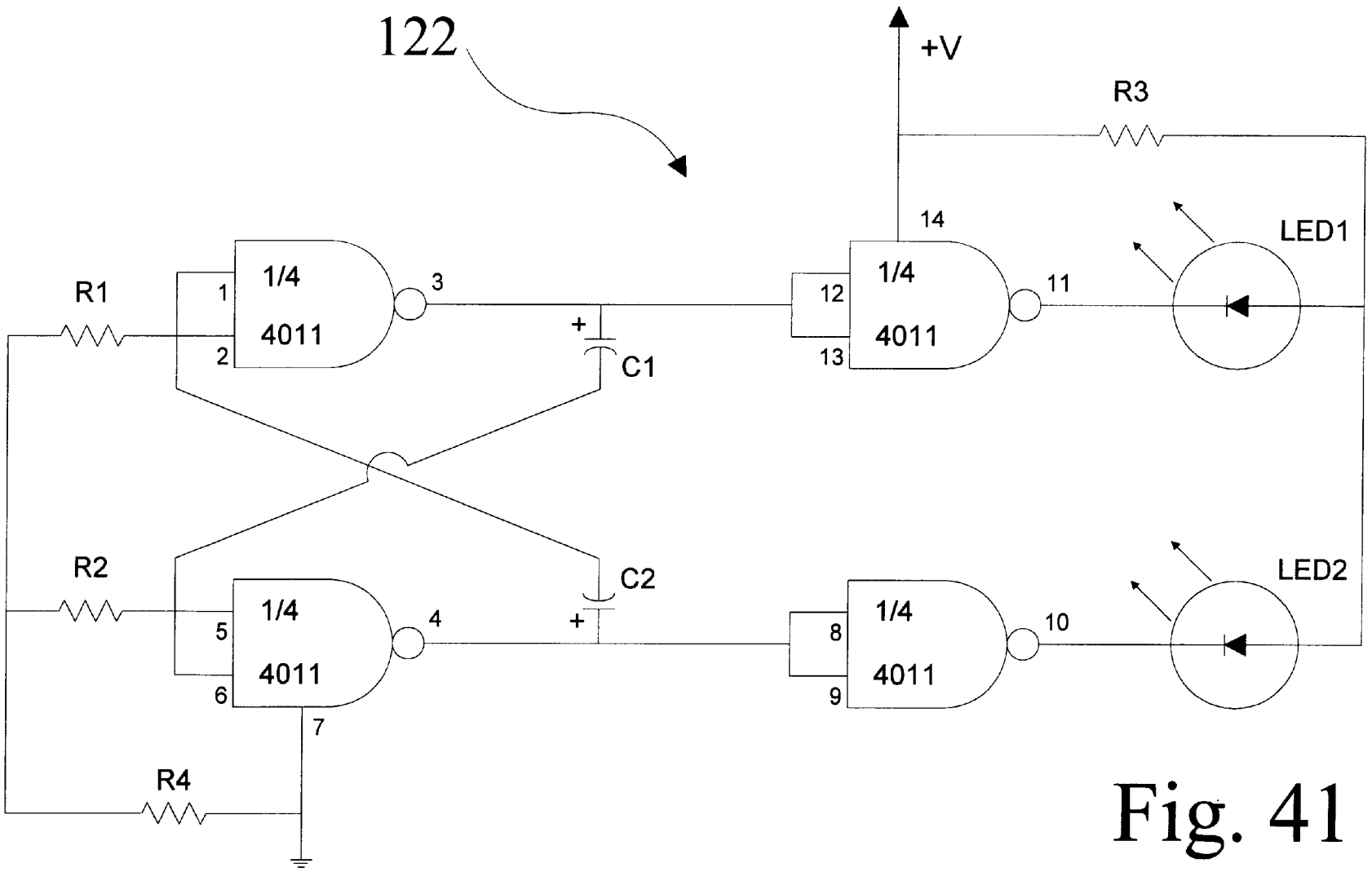

FIG. 41 shows an alternative embodiment of the disclosed invention which uses four 4011 Op Amps, CMOS1, CMOS2, CMOS3 and CMOS4 to pulse two LEDs. Capacitors C1 and C2 control the pulse rate; reduce the values of either or both to increase the pulse rate. Here C1 and C2 are both 33 $\mu$F, yielding a 1 Hz pulse rate. Resistors R1 through R4 are respectively 4.7 kΩ, 4.7 kΩ, 1 kΩ and 1 kΩ.

FIG. 12 reveals a shoe 124 which incorporates the invention.

The invention may be employed in waterproof packages or to mark underwater objects which can be picked up or identified later from the air. Groups such as the Boy Scouts or Girl Scouts which hike into a wilderness area could be provided with emitters along with their camping permits. FIG. 42 shows the invention embedded in the sole of a show such as for children. The U.S. Border Patrol might employ the invention to identify power lines, power poles, cliffs, valleys or openings in terrain during night helicopter flights.

Various law enforcement personnel could identify search and rescue team members, locate automobiles or mark or locate evidence. The U.S. Forest Service could use the invention to monitor animal migration patterns or track campers. The emitter described above offers virtually unlimited recreational applications. A skier could wear an emitter on his or her jacket, or the unit could be mounted within a ski pole. Cars or motorcycles participating in cross country races could be identified from great distances. The present invention may be permanently installed on any vehicle that utilizes a built-in battery. Backpackers, cyclists, hunters and hikers could carry the invention in the event they encountered difficulty and required assistance.

Alternative embodiments of the present invention include various military applications, such as a system for identifying friendly personnel. The IR emitter could be programmed to operate at a predetermined frequency modulation or intensity modulation which would be kept as a secret by all operation commanders. Various battlefield locations or targets could be identified as depicted in FIG. 23. Landing pads 64 or landing strips 68 could be marked for covert operations, as shown in FIG. 24.

USE OF DETECTORS WITH THE PRESENT INVENTION

The emitter may be detected in a variety of ways using commercially available IR night vision equipment. In darkness, infrared radiation produced by the invention generally illuminates its surroundings. The IR energy reflects off of the ground, surrounding foliage, concrete or stone. This energy can be perceived as ghostly images through a night vision imaging systems (NVIS). The IR radiation also "blooms", creating a halo-like glow in the area of the emitter. Conventional night vision scopes are equipped with automatic gain control (AGC), which enables the user to immediately sense the presence of IR. The AGC feature prevents the pilot or scope user from being blinded or disoriented.

CONCLUSION

Although the present invention has been described in detail with reference to a particular preferred embodiment, persons possessing ordinary skill in the art to which this invention pertains will appreciate that various modifications and enhancements may be made without departing from the spirit and scope of the claims that follow. The various alternatives for radiation sources, power supplies, pulse control circuits, housings and mounting means that have been disclosed above are intended to educate the reader about preferred embodiments of the invention, and are not intended to constrain the limits of the invention or the scope of the claims. The List of Reference Characters which follows is intended to provide the reader with a convenient means of identifying elements of the invention in the Specification and Drawings. This list is not intended to delineate or narrow the scope of the claims.

LIST OF REFERENCE CHARACTERS

10 Automatic Long-Life Infrared Emitter & Locator System
12 Housing
13 First lower end of housing
14 Second upper end of housing
15 Opening of housing
16 Nine volt electric battery
17*a* Battery terminal
17*b* Battery terminal
18 Focusing lens
19*a* Lead from battery terminal to pulse control circuit
19*b* Lead from pulse control circuit to infrared emitting diode
19*c* Lead from infrared emitting diode to battery terminal
20 Infrared emitting diode
21 Continuous periodic intermittent output
22 Pulse control circuit mounted inside housing
24 On-off switch
26 Velcro™ adhesive patch mounted on battery
28 Graph of voltage v. current drain
30 Plot of intensity v. distance
32 Graph of radiation output v. Forward Current
34 Graph Relative radiation output v. Ambient temperature
36 Graph of Relative radiation output v. Angular displacement
38 Plot showing Relative Radiation Output v. Wavelength
40 Cap
42 Article of clothing
44 Backpack
46 Ski pole
48 Racing car
50 Speed boat
52 Passenger car
54 Life raft
56 Power lines
57 Power line tower
58 Aircraft
60 Military aircraft
62 Marking beacon
64 Helipad
66 Landing guide
68 Landing strip
70 Embodiment of the invention including photovoltaic cell and swivel ring
72 Photovoltaic cell
74 AA battery
76 Swivel ring
78 Embodiment of the invention including shrink wrap housing
80 Top cap with emitter
82 Lower end cap
84 Shrink wrap housing
86 Circuit board
88 Strap of backpack
90 Backpack
92 Life jacket
94 Collar of child's shirt
96 Alternative embodiment including adhesive patch
98 Adhesive patch
100 Alternative embodiment including cinch strap
102 Cinch strap
104 LM 3909 circuit
106 ZN2907 transistor circuit
108 555 timer circuit
110 Capacitor discharge circuit
112 Gated circuit
114 MOSFET circuit
116 Flasher driver circuit
118 Dual LED circuit
120 TTL dual circuit
122 CMOS alternating circuit
124 Invention incorporated in shoe

What is claimed is:

1. An electronic locating apparatus comprising:

a molded, lightweight, integrally-formed generally flexible housing (12); said molded, lightweight, integrally-formed generally flexible housing (12) having a first end (13) and a second end (14); said molded, lightweight, integrally-formed generally flexible housing (12) also having an opening (15) disposed at said first end (13);

an electric dry cell battery (16); said electric dry cell battery (16) having an exterior shape which is generally matched to said opening (15) disposed at said first end (13) of said molded, lightweight, integrally-formed generally flexible housing (12); said electric dry cell battery (16) being capable of fitting securely within said molded, lightweight, integrally-formed generally flexible housing (12);

a pulse control circuit (22); said pulse control circuit (22) being mounted within said opening (15) of said molded, lightweight, integrally-formed generally flexible housing (12); said pulse control circuit (22) also being connected to said electric dry cell battery (16); said pulse control circuit (22) including an on-off switch (24); said pulse control circuit (22) being capable of automatically producing a continuous periodic intermittent output (21) over a period of many weeks;

an infrared emitting diode (20); said infrared emitting diode (20) being connected to said electric dry cell battery (16) through said pulse control circuit (22);

a lens (18); said lens (18) being integrally formed on said molded, lightweight, integrally-formed generally flexible housing (12) at said second end (14) of said molded, lightweight, integrally-formed generally flexible housing (12) opposite said electric dry cell battery (16); said lens (18) being generally aligned with said infrared emitting diode (20); said lens (18) also being capable of passing said continuous periodic intermittent output (21) emanated by said infrared emitting diode (20);

an adhesive patch (26) attached to said electric dry cell battery (16) for affixing said molded, lightweight, integrally-formed generally flexible housing (12) on a desired location;

said continuous periodic intermittent output (21) being sufficiently bright to help locate said infrared emitting diode (20) without being visible to the unaided eye; and said molded, lightweight, integrally-formed generally flexible housing (12) being suitable for use in combination with a swivel ring (76) that uses the weight of the lower end of said apparatus to maintain said diode (20) in an upright position in the event the person wearing said apparatus becomes incapacitated.

2. An electronic locating apparatus comprising:

a molded, lightweight, integrally-formed generally flexible housing (12); said molded, lightweight, integrally-formed generally flexible housing (12) having a first end (13) and a second end (14); said molded, lightweight, integrally-formed generally flexible housing (12) also having an opening (15) disposed at said first end (13);

an electric dry cell battery (16); said electric dry cell battery (16) having an exterior shape which is generally matched to said opening (15) disposed at said first end (13) of said molded, lightweight, integrally-formed generally flexible housing (12); said electric dry cell battery (16) being capable of fitting securely within said molded, lightweight, integrally-formed generally flexible housing (12);

a pulse control circuit (22); said pulse control circuit (22) being mounted within said opening (15) of said molded, lightweight, integrally-formed generally flexible housing (12); said pulse control circuit (22) also being connected to said electric dry cell battery (16); said pulse control circuit (22) including an on-off switch (24); said pulse control circuit (22) being capable of automatically producing a continuous periodic intermittent output (21) over a period of many weeks;

an infrared emitting diode (20); said infrared emitting diode (20) being connected to said electric dry cell battery (16) through said pulse control circuit (22);

a lens (18); said lens (18) being integrally formed on said molded, lightweight, integrally-formed generally flexible housing (12) at said second end (14) of said molded, lightweight, integrally-formed generally flexible housing (12) opposite said electric dry cell battery (16); said lens (18) being generally aligned with said infrared emitting diode (20); said lens (18) also being capable of passing said continuous periodic intermittent output (21) emanated by said infrared emitting diode (20);

an adhesive patch (26) attached to said electric dry cell battery (16) for affixing said molded, lightweight, integrally-formed generally flexible housing (12) on a desired location;

said continuous periodic intermittent output (21) being sufficiently bright to help locate said infrared emitting diode (20) without being visible to the unaided eye; and said molded, lightweight, integrally-formed generally flexible housing (12) being suitable for deployment on a life jacket (92) and which is mounted so that it automatically swivels upward to aid sighting.

* * * * *